US007770871B1

(12) United States Patent
Swenson et al.

(10) Patent No.: US 7,770,871 B1
(45) Date of Patent: Aug. 10, 2010

(54) INTERNAL WINCH SYSTEM FOR A FLAGPOLE

(75) Inventors: Paul Swenson, Salt Lake City, UT (US); Mark Dickey, Salt Lake City, UT (US)

(73) Assignee: Colonial Discount Flag & Flagpole, Sandy, UT (US)

( * ) Notice: Subject to any disclaimer, the term of this patent is extended or adjusted under 35 U.S.C. 154(b) by 0 days.

(21) Appl. No.: 12/240,772

(22) Filed: Sep. 29, 2008

Related U.S. Application Data

(60) Provisional application No. 60/995,730, filed on Sep. 28, 2007.

(51) Int. Cl.
*B66D 1/14* (2006.01)

(52) U.S. Cl. ..... 254/364; 192/41 A; 192/44; 192/45; 116/173

(58) Field of Classification Search ..... 254/332, 254/329, 364, 370; 192/45.1, 41 A, 44, 45; 116/173, 174
See application file for complete search history.

(56) References Cited

U.S. PATENT DOCUMENTS

| | | | | | |
|---|---|---|---|---|---|
| 2,530,654 | A | | 11/1950 | Ellis | |
| 3,952,695 | A | * | 4/1976 | Vollstedt | 116/173 |
| 4,236,618 | A | | 12/1980 | West | |
| 4,369,952 | A | * | 1/1983 | Kurling | 254/353 |
| 4,413,713 | A | | 11/1983 | West | |
| 4,682,968 | A | * | 7/1987 | Droller et al. | 446/268 |
| 4,889,321 | A | * | 12/1989 | Burns | 254/332 |
| 5,004,177 | A | | 4/1991 | Somers | |
| 5,168,828 | A | * | 12/1992 | Smyly, Sr. | 116/173 |
| 5,364,074 | A | | 11/1994 | Gourley | |
| 5,482,144 | A | | 1/1996 | Vranish | |
| 5,769,349 | A | * | 6/1998 | Grosselin | 242/385.1 |
| 6,109,409 | A | | 8/2000 | Creech | |
| 6,644,630 | B1 | | 11/2003 | Lorenz | |
| 6,758,159 | B2 | * | 7/2004 | McCudden et al. | 116/173 |
| 7,451,720 | B2 | * | 11/2008 | Somers | 116/173 |
| 7,530,325 | B2 | * | 5/2009 | Swenson et al. | 116/173 |

OTHER PUBLICATIONS www.anyflag.com/flagpoles/harware/halparts.php, American Flag and Gift, accessed Jan. 18, 2007, 16 pages.
www.americanflagstore.com/hardware/winch.htm, Flagpole Winch, accessed Jan. 18, 2007, 2 pages.
Goddard Space Flight Center, Technical Support Package, Clutch combined with screw-released roller brake, NASA Tech Briefs, 29 pages.
Goddard Space Flight Center, Technical Support Package, Roller unlocking sprags, NASA Tech Briefs, 18 pages.

* cited by examiner

*Primary Examiner*—Emmanuel M Marcelo
(74) *Attorney, Agent, or Firm*—Thorpe North & Western LLP

(57) ABSTRACT

A flagpole winch that fits inside the internal hollow space a flagpole and is configured to alternatively wind or unwind a cord spool or to lock the cord spool into a rotational position. The winch uses a release spindle that unlocks an actuator mechanism when turned in either direction, allowing the cord spool to be positively rotated in either direction. Once the positive input or turning ceases, the continuous tension on the cord causes the actuator mechanism to automatically lock to arrest the cord spool.

14 Claims, 16 Drawing Sheets

INTERNAL WINCH SYSTEM FOR A FLAGPOLE

RELATED APPLICATIONS

This application claims the benefit of U.S. Provisional Patent Application No. 60/995,730 filed Sep. 28, 2007 in the United States Patent and Trademark Office, and entitled, "Internal Winch System for a Flagpole," which application is incorporated by reference in its entirety herein.

FIELD OF THE INVENTION

The present invention relates to methods and systems for raising and lowering flags about a flagpole and more particularly to winch systems operable with a flagpole to raise and lower flags.

BACKGROUND OF THE INVENTION AND RELATED ART

Small, manually operated or motorized winches have innumerable applications and are used for a variety of tasks, including raising and lowering flags on flagpoles. When used with a flagpole, the winches may be mounted to the outside of the pole or inside the hollow interior, as is the case with internal halyard flagpole designs. In spite of their increased expense, interior mounted winches are quite popular as they offer several advantages over exterior winches. The flush outer surface of a flagpole with an interior winch is both more aesthetically pleasing and safer than an exterior winch, as it eliminates the potential bump hazard caused by a hard, protruding object at torso level. An additional advantage comes from having both the winch and the cord enclosed within the flagpole and protected from the elements, which significantly extends the useful life of the winch system. And finally, it is easier to secure a flagpole with an internal winch from unauthorized tampering or vandalism as both the winch and the reachable section of the cord can be secured behind a locked door or access cover.

Internal winches are not without problems of their own, however. An access passage for installing and operating the winch must be drilled or machined into the side of the flagpole near its base, which may create regions with high stress concentration factors that significantly weaken the overall pole structure. And because entry to the apparatus is constrained by the size of the opening, some traditional winch designs, such as the common ratchet winch, are precluded from being installed inside the flagpole. Furthermore, maintenance and repair operations also become more difficult with the restricted access to the components of the winch located inside the flagpole.

The internal winch is also limited in capacity by the outer frame and support structure of the apparatus, otherwise known as the shield. As the volume between the cord spool and the shield is finite, both the amount of available cord and the useful height of the flagpole are limited. The shield also contributes to the common problem of clogging, which occurs when loops of the cord become bound inside the winch between the spool and the internal surface of the shield.

All these considerations must be taken into account in designing a flagpole winch that performs the basic functions of easily raising and lowering the flag, and then reliably locking the winch to secure the flag in its new position. It is important that the locking mechanism prevent the winch from unreeling despite severe weather conditions, such as stiff breezes and gusting winds that are capable of imparting instantaneous high loads on the brake or locking mechanism. It is an additional constraint that winch operations be inherently safe and easy to operate since flagpole duties are often given to the young or unskilled. And from an economic and manufacturing perspective, it would be more cost-effective to produce a family of internal flagpole winches of standardized sizes that could readily be adapted to fit into uncut stock flagpoles of different diameters using simple machining methods.

One of the more common internal winch designs used in flagpoles is today is the brake winch. A brake winch typically has a square cross-sectional frame surrounding a cylindrical spool, with provisions for a detachable winch handle on one end of the spool and a cast bronze internal brake at the other. The internal brake is modeled after the brake drum on an automobile, with the exception that the brake winch only releases when rotational pressure is exerted by the winch handle. Like the drum brake on an automobile, however, the brake winch is subject to frictional wear and requires periodic maintenance.

While its simple and straightforward operation is an advantage, the installation of the brake winch creates significant problems. First, the square cross-section of the winch requires that a square hole to be machined into the sidewall of the flagpole. Even with large-radius corners, a square hole in the sidewall of the pole creates stress concentration factors sufficient to decrease the overall strength of the pole and move the weakest point of the structure from the base of the pole up to the winch location. To compensate at least in part, a welded reinforcement is often added around the edges of the opening and a door is installed over the breach to stiffen the pole when the winch is not actively being turned. However, any additional welding on the pole requires heat treatment to temper the new weld material, which heat treatment must be completed prior to anodizing the flagpole. These additional installation steps require that the flagpole be cut and prepared to receive the brake winch while still in the factory, and that distributors stock their inventory with a wide variety of poles in different configurations in order to quickly respond to customer orders.

One current alternative to the brake winch that alleviates some of the installation difficulties is the "M" winch, which is a smaller, self-locking winch having a cylindrical configuration. The round cross-section of the "M" winch only calls for a circular opening to be cut into the sidewall of the flagpole. This eliminates the need for additional reinforcement or welding because a smooth, round hole does not result in stress concentration factors high enough to significantly weaken the flagpole, as long as the opening is not too large. Furthermore, a round opening can be easily cut into a blank pole with a common hole saw, which facilitates field installation. Thus the "M" winch resolves many of the installation problems associated with brake winches.

However, the "M" winch does have issues relating to its operation. The "M" winch design uses a spool having a spring-loaded end plate with a number of axially orientated pins that fit within a series of machined slots in the housing. When the pins are engaged within the slots, the spool is locked. The winch is turned by first pushing inward on the handle to release the spins from the slots, and then rotating the handle to turn the spool. Operation of the "M" winch is more complicated than with a brake winch, as the user must simultaneously apply both inward pressure and rotational force while turning the device. Releasing the inward-directed force allows the spring-loaded spool to re-engage with the stationary slots and lock in its new rotational position. It has been observed, however, that on occasions when the winch is heavily loaded the end plate pins may skip backwards over the slots after the operator releases the handle. And if the winch is allowed to gain sufficient rotational momentum, the spool may unreel completely.

Another disadvantage of the "M" winch is that its capacity is even smaller than that of the brake winch design, as all the cord must fit within the shield's cylindrical housing. And because of the tight space between the shield and the spool, the "M" winch is more susceptible to clogging.

SUMMARY OF THE INVENTION

In light of the problems and deficiencies inherent in the prior art, the present invention seeks to overcome these shortcomings by providing an internal flagpole winch that offers easy bi-directional rotation and reliable locking while at the same time surmounting the capacity limitation and clogging issues found in earlier designs. The present invention also resolves many installation concerns found in the prior art by requiring only a few, simple machining operations to install the apparatus, which procedures can easily be performed in the field on blank flagpoles. Moreover, despite being installed inside the structure, the winch of the present invention provides a means for securing the winch to the pole which actually contributes to its structural integrity and moves any potential failure point away from the winch location and back down to the base of the flagpole.

In accordance with an exemplary embodiment as broadly described herein, the present invention features an internal winch for a flagpole which fits into a circular hole cut into the sidewall of the flagpole, but does not require a shield or outer frame to provide structural support for the winch. Instead, the winch uses an internal, axial support system attached to both sides of the flagpole to help align and carry the cord spool. By eliminating the shield frame and any outer structural supports located in the space between the cord spool and the interior walls of the hollow flagpole, the present invention becomes bounded only by the interior surfaces of the pole. This change results in significant benefits, as it eliminates the potential for cord clogs between the wound spool and the stationary frame or shield, and it increases the internal winch's cord capacity. The increase in capacity, in turn, enables flagpoles using flush-mounted internal winches to be taller for a given base thickness, resulting in aesthetically pleasing designs that have more slender and graceful profiles.

In another exemplary embodiment, the present invention also provides for a novel turning and locking system that allows for easy, bi-directional operation of the winch simply by turning a handle, but then supplies a reliable braking and a secure locking of the cord spool as soon as the force rotating the winch is removed. A key component of this turning and locking system is the release spindle, which has an axle that simultaneously supports the cord spool in the radial direction and provides an axis of rotation about which the cord spool freely spins. The release spindle also includes an actuator disc which interfaces with a clutch mechanism. Both the actuator disc and the clutch mechanism are enclosed within the outer brake ring of a brake drum. Furthermore, the backside of the clutch mechanism is directly coupled to the proximal end of the cord spool, forming a clutch mechanism/cord spool sub-assembly. When the release spindle is not rotating, the clutch mechanism is positively locked against the inner surface of the brake ring, which in turn locks the cord spool in its rotational position and prevents it from spinning, regardless of the forces or loads imparted through the cord onto the spool by adverse weather conditions acting on the flag.

Positively rotating the release spindle causes components in the actuator disc to push against components in the clutch mechanism, forcing the clutch mechanism/cord spool sub-assembly to disengage from the brake ring and link up, or follow along, with the rotating actuator disc. Thus the clutch mechanism/cord spool sub-assembly turns together with the release spindle when the release spindle is rotated by an external force. This linking up with the rotating actuator disc occurs regardless of whether the release spindle is being turned in a direction that winds the cord onto the cord spool or in a direction that unwinds the cord. However, as soon as the positive force turning the release spindle is removed, the clutch mechanism disengages from the actuator disc and locks back up with the stationary brake ring, strongly securing the clutch mechanism/cord spool sub-assembly in its new rotational position. The position of the flag on the flagpole is thus secured despite stiff breezes and gusting winds which impart instantaneous high loads on the locking mechanism of the present invention.

In accordance with yet another exemplary embodiment, the present invention features a flagpole winch that is configured to fit within a flagpole and facilitate winding and unwinding an attached halyard cord. The flagpole winch includes a cover plate that is attachable to an outside surface of a near sidewall of a flagpole and a ring bushing coupled to the backside of the cover plate with an inner bushing surface configured for rotatably supporting a release spindle. The rotatable release spindle comprises an actuator disc having a circular front flange that is rotatably disposed within the ring bushing, an axle extending internally from the center of the actuator disc, and an actuator arm extending internally from an outer portion of the actuator disc. The winch further includes a non-rotating elongate bushing having a distal portion and a proximal portion, with the distal portion coupled to a far sidewall of the flagpole and the proximal portion having a bore for receiving the axle of the rotatable release spindle. The winch also includes a cord spool that is rotatably disposed on the distal portion of the elongate bushing and which is configured to receive and support a cord between a distal spool flange and a proximal spool flange. The cord spool also has first and second spool arms that extend outwardly from the proximal spool flange.

The flagpole winch further includes a torsion spring that is rotatably disposed about the proximal portion of the elongate busing and between the proximal flange of the cord spool and the actuator disc of the release spindle. The torsional spring has first and second spring ends that are configured to engage with the first and second spool arms, so that a tension force applied to the cord spool acts to engage one of the first and second spool arms with one of the first and second spring ends, causing the torsional spring to close and bind about proximal portion of the elongate bushing and prevent further rotation of the cord spool.

The flagpole winch further allows for a manual rotatable force to be applied to the release spindle, which rotatable force operates to engage the actuator arm of the release spindle with one of the first and second spring ends, to overcome the tension force and cause the torsional spring to release the proximal portion of the elongate bushing, allowing for the rotation of the cord spool in the direction of the manual rotatable force.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

Figure 1:
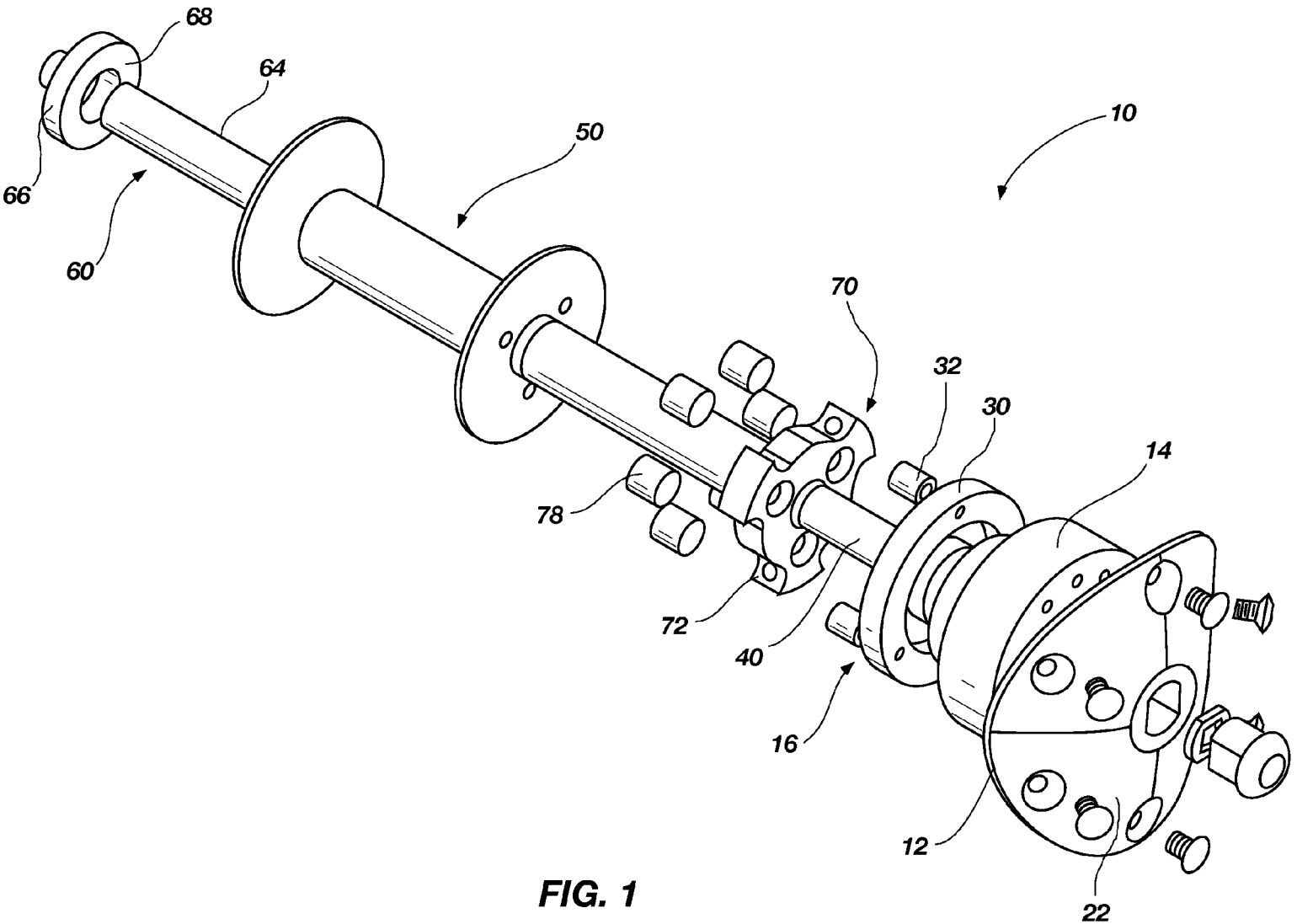
FIG. 1 illustrates an exploded, perspective view of an exemplary embodiment of an internal winch ideally suited for use within a flagpole.
Figure 2C:
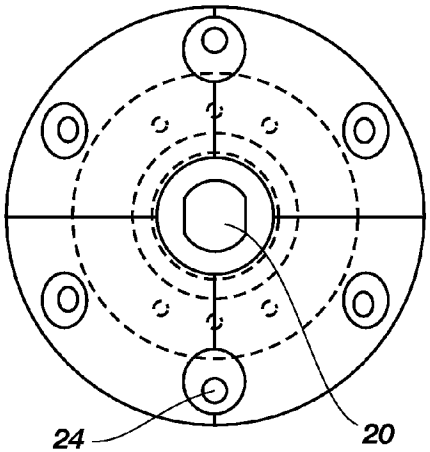
FIGS. 2*a*-2*d* together illustrate front, side, back and perspective views of a cover plate, according to the exemplary embodiment of the present invention shown in FIG. 1.
Figure 2B:
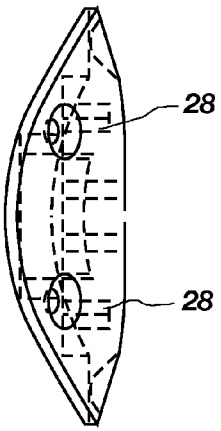
Figure 2A:
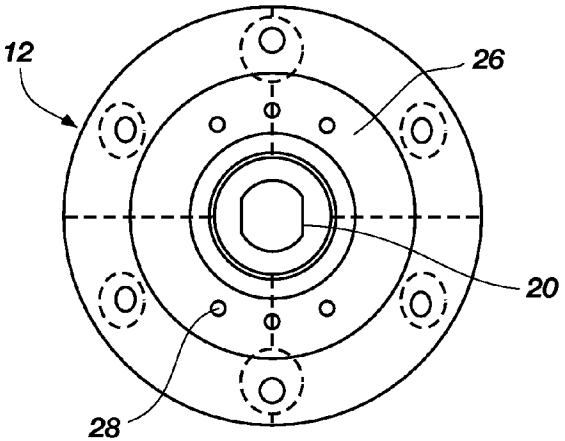
Figure 2D:
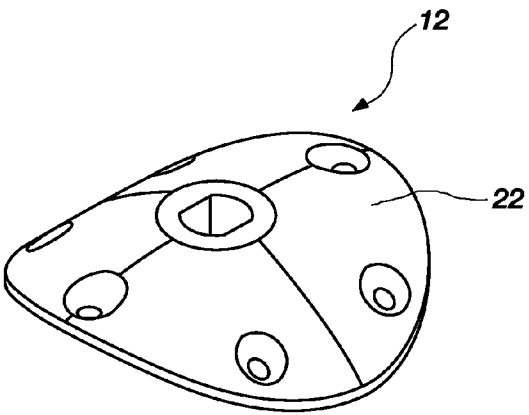

With reference to FIG. 1, illustrated is an exploded, perspective view of an exemplary embodiment of an internal flagpole winch 10 ideally suited for use with a flagpole employing an internal halyard or similar interior cord configuration. The winch can be comprised of four principle sub-assemblies. The cover plate 12/brake drum 14 sub-assembly can include the cover plate 12 and the brake drum 14, which are the two stationary components attached to the proximal end of the winch. The cover plate 12 can have a large front face 22 which is curved to match the rounded surface of the flagpole. The brake drum 14 can attach to the backside of the cover plate 12 and, when installed, extend into the interior of the flagpole.

The next sub-assembly is the release spindle 16 which can have two portions: an actuator disc portion 30 and an axle portion 40. The actuator disc 30 can be orientated perpendicular to the centerline of the rotating assembly, fits snuggly inside the brake drum 14 and has a bushing surface on its front face and outer edges which allows it to spin freely inside the brake drum. The actuator disc can have a number of cam unlock rollers 32 attached at equally spaced intervals around the interior face of the disc, near the outer edge.

The axle 40 can extend from the center of the actuator disc 30 partway into the hollow center of the flagpole. It can be integral to and rotate with the actuator disc 30, and provide partial support for the third sub-assembly: the cord spool 50 and the roller cam 70. The cord spool 50/roller cam 70 sub-assembly can slide onto the axle 40 and can have bushings inside the spool which allow it to spin freely about the axle 40. The roller cam 70, the principal component of the clutch mechanism, can be attached to the front face of the proximal end of the cord spool 50 and can have multiple symmetrically-curved sprockets 72, equal in number to the number of unlock rollers 32, extending radially from a small central disc section 74. Like the cord spool 50, the roller cam 70 can also have a central passage or bore which allows it to slide over the axle 40. In its assembled position, the roller cam can fit snuggly within the brake drum 14 and against the interior face of the actuator disc 30, with the sprockets 72 sliding between the unlock rollers 32.

The release spindle 16 and the cord spool 50/cam roller 70 sub-assemblies can be configured to rotate both one relative to the other and together in unison. The selection of which form of rotation takes place can be determined by the pairs of floating locking rollers 78 which are positioned in the spaces between the unlock rollers 32 and the sprockets 72. There can be two locking rollers 78 for each unlock roller 72. Each locking roller 78 can be enclosed within a volume bounded by the actuator disc 30 and the proximal end of the cord spool 50 on either end, the roller cam 70 and the unlock roller 32 on the bottom and sides, and the brake drum 14 on the top. However, the locking roller 78 can be free to rotate and slide anywhere within this limited volume. Stated differently, each locking roller 78 can be configured and able to float within this volume. The cam unlock rollers 32 on the actuator disc 30, the floating locking rollers 78, the roller cam 70 and the brake ring 44 of the brake drum 14 together combine to form what is otherwise known as the clutch mechanism.

The fourth component is the fixed support shaft 60/spool spacer 64 sub-assembly which attaches to the far sidewall of the flagpole and provides additional support for the distal end of the cord spool. The support shaft 64 can be co-axial with the axle portion 40 of the release spindle 16 and can have the same diameter while filling the remainder of the gap between the end of the axle 40 and far sidewall of the flagpole. The spool spacer 66 can have a curved distal surface that matches the curved interior surface of the far sidewall, and the length of the body can be configurable to fill any remaining distance between the distal end of the cord spool 50 and the far sidewall. The proximal face of the spool spacer 66 can have a bushing surface 68 to allow the cord spool 50 to ride up against the spool spacer 66 and still spin freely.

The flagpole (not shown) can be prepared to receive the internal winch by cutting a circular winch hole in the side of the flagpole with a standard hole saw. The winch hole can be configured to be large enough to accommodate the internal components of the winch, but small enough to be completely enclosed by the outer edges of the cover plate. A smaller screw hole can be drilled and countersunk directly opposite and in line with the centerline of the winch hole to allow for the attachment of the support shaft 60/spool 64 spacer sub-assembly.

Illustrated in FIGS. 2*a*-2*d* are more detailed views of the cover plate 12. The cover plate 12 can have a large front face 22 with edges that extend some distance beyond the limits of the winch hole cut into the sidewall of the flagpole. The front face 22 can have a thickness and a curvature that matches the outer curvature the sidewall, and mounts flush against the sidewall when installed. A number of countersunk screw holes 24 can be located around the circumference of the cover plate 12 to allow for installation using self-tapping machine screws. A significant advantage offered by the present invention over the prior art is that the thickness of the cover plate 12, combined with its secure attachment by self-tapping machine screws around its entire circumference, can allow the cover plate to replace the structural integrity lost by cutting the winch hole into the sidewall of the flagpole. With the present invention, instead of creating a weak point in the flagpole at the location of the internal winch, the cover plate 12 can reinforce the structure of the flagpole near the winch hole and move the weak point back down to the base of the flagpole, where it would be located had the flagpole remained unmodified.

The backside of the cover plate 12 has a smaller, circular flat face portion 26 which can be generally perpendicular to the centerline of the front face 22 and which can fit into the circular winch hole to provide a platform upon which the rest of the apparatus is built. However, the flat face 26 can be aligned with a small angle relative to the centerline of the front face 22 to accommodate sharply tapered flagpoles, so that even when the cover plate 12 mates flush against the outer surface of sharply tapered flagpole, the flat face 26 can remain parallel to the flagpole's vertical centerline. The flat face 26 can have screws holes 28 for attachment of the brake drum 14.

Figures 3A, 3B:
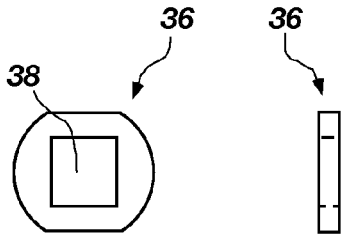
FIGS. 3*a* and 3*b* together illustrate front and side views of a lock pawl, according to the exemplary embodiment shown in FIG. 1.

The cover plate 12 can have a center slot 20 extending from the front face 22 to the backside flat face 26 that provides access to the workings of the internal winch via a crank, as discussed hereinafter. The center slot 20 can be configured with a short section having an oblong profile with flattened sides, followed by another short section having a circular profile of the same diameter. This configuration can permit the installation of a locking pawl 36, as shown in FIGS. 3*a* and 3*b*, that can be inserted through the oblong section and then turned 90 degrees to be locked to place, blocking access to the internal workings behind. The locking pawl 36 can be configured with an interface 38 that can only be fitted with a custom tool provided by the manufacturer, thereby eliminating the opportunity for unauthorized users to remove the locking pawl 36 and gaining access to the operations of the winch 10. The interface 38 can be a square hole in the exemplary embodiment shown. The center slot 20 of the cover plate 12 can also be secured with a standard, keyed cabinet lock, or with any other locking means available in the art.

Figures 4A, 4B:
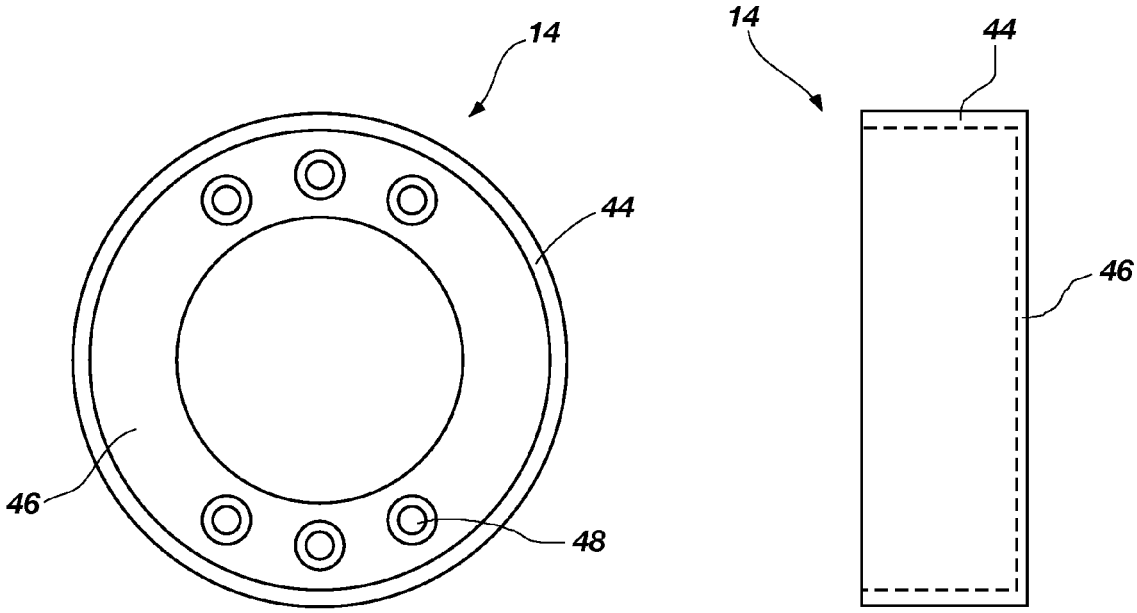
FIGS. 4*a* and 4*b* together illustrate front and side views of a brake drum, according to the exemplary embodiment shown in FIG. 1.

FIGS. 4*a* and 4*b* are illustrative of the roller brake drum 14. The brake drum 14 can have an attachment face portion 46 and a brake ring portion, and can be connected to the backside flat face 26 of the cover plate 12 by machine screws inserted though screw holes 48 in the attachment face 46. Furthermore, the attachment face 46 can have a central hole to allow access to the internal workings of the winch via the center slot 20.

The brake ring portion 44 of the brake drum 14 can be concentric with the centerline of the winch apparatus and extends into the hollow interior of the flagpole when installed. The inner surface on the brake ring 44 can be configured to provide a smooth bearing surface against which several components of the internal winch may slide or roll, and against which the locking rollers may bind to lock the clutch mechanism into a rotational position. In addition, the brake ring 44 can provide structural support and alignment for the winch apparatus by supporting and the aligning the actuator disc portion of the release spindle.

Figure 5A:
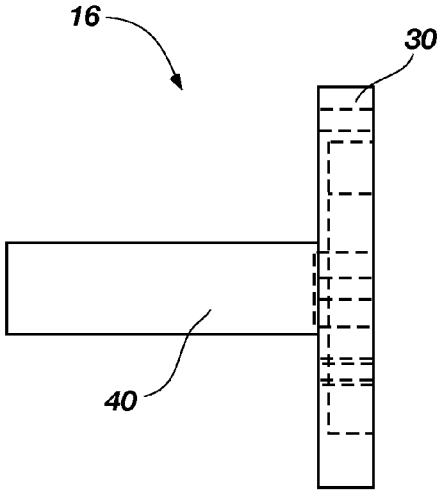
FIGS. 5*a* and 5*b* together illustrate front and side views of a release spindle, according to the exemplary embodiment shown in FIG. 1.
Figure 5B:
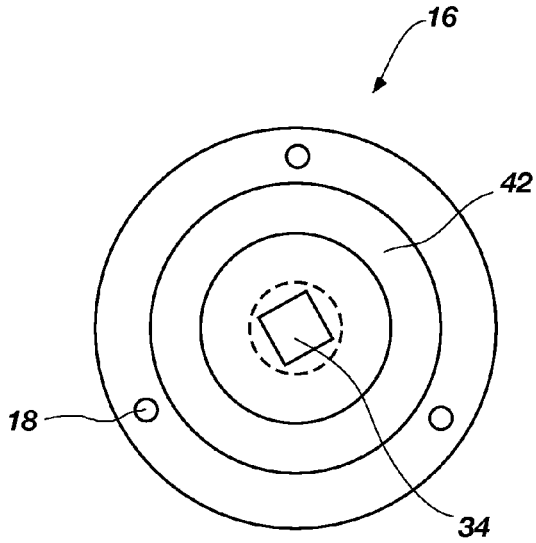

A front and side view of the release spindle 16 is shown in FIGS. 5*a* and 5*b*. The release spindle 16 can be comprised of an actuator disc portion 30 and an axle portion 40. The actuator disc 40 can be configured to be slidably inserted into the brake drum 14 and to contact both the vertical attachment face of the brake drum and the inner surface of the brake ring. The front face of the actuator disc 30 can be configured with a recess 42 or groove to limit the contact area between the two flat surfaces to a brake ring portion that can more easily be treated with a bushing material. Furthermore, the outer rim of the actuator disc 30 can also be treated with a bushing material that allows free rotation of the actuator disc 30 within the brake ring.

The center portion of the actuator disc 30 can be configured with a profiled cutout 34 that can be engaged by a crank (see FIG. 6). To operate the winch, the center slot lock can be removed and the crank tip can be inserted through the cover plate/brake drum sub-assembly to mechanically engage the profiled cutout in the release spindle 16. The cutout 34 can have a square cross-section as shown in the exemplary embodiment, a hexagonal cross-section, or any other standard or customized design that can be configured to mate with the corresponding crank tip.

Figure 7B:
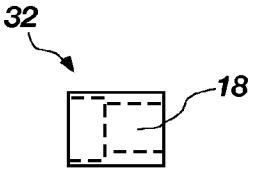
FIGS. 7*a* and 7*b* together illustrate front and side views of a cam unlock roller, according to the exemplary embodiment shown in FIG. 1.
Figure 7A:
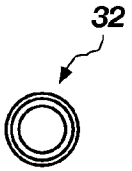

The actuator disc portion 30 of the release spindle 16 can have provisions for fixably mounting a number of freely-spinning cam unlock rollers 32 (see FIG. 7) around the circumference of the interior face at equally spaced attachment points 18, as shown in the exemplary embodiment. However, nothing in the drawings nor the specification should be construed to limit the quantity of unlock rollers to three, as any internal winch configuration having two or more equally-spaced unlock rollers falls within the scope of the present invention. Upon assembly, the cam unlock rollers 32 will engage the locking rollers positioned between the unlock rollers and sprockets of the roller cam.

As further shown in FIG. 5*a*, the release spindle 16 can have an axle portion 40 that can be integral with the actuator disc 30 and that extends further into the interior of the flagpole. The axle 40 can be configured to support and align the proximal end of the roller cam/cord spool sub-assembly with the actuator disc 30 and the brake drum. The axle 40 can turn with the actuator disc 30 when the release spindle 16 is engaged by a crank 4, and at the same time can provide a bearing surface upon which the cord spool may rotate when the release spindle 16 is not turning.

Figure 6A:
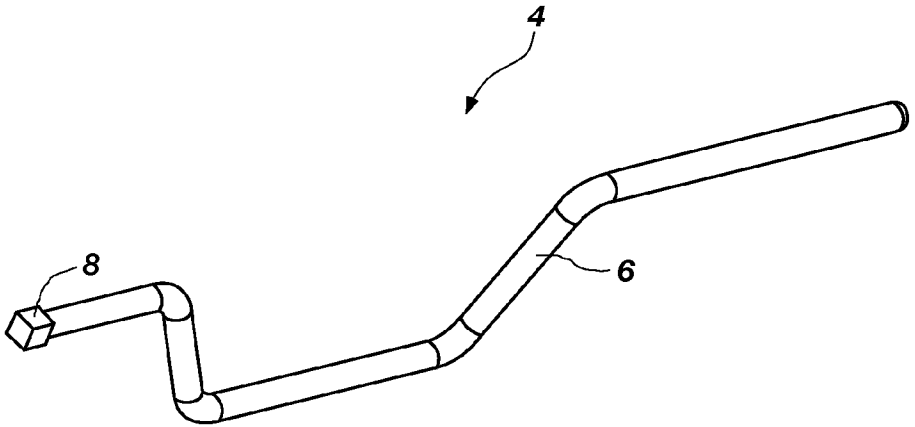
FIGS. 6*a* and 6*b* together illustrate perspective and side views of a crank, according to the exemplary embodiment shown in FIG. 1
Figure 6B:
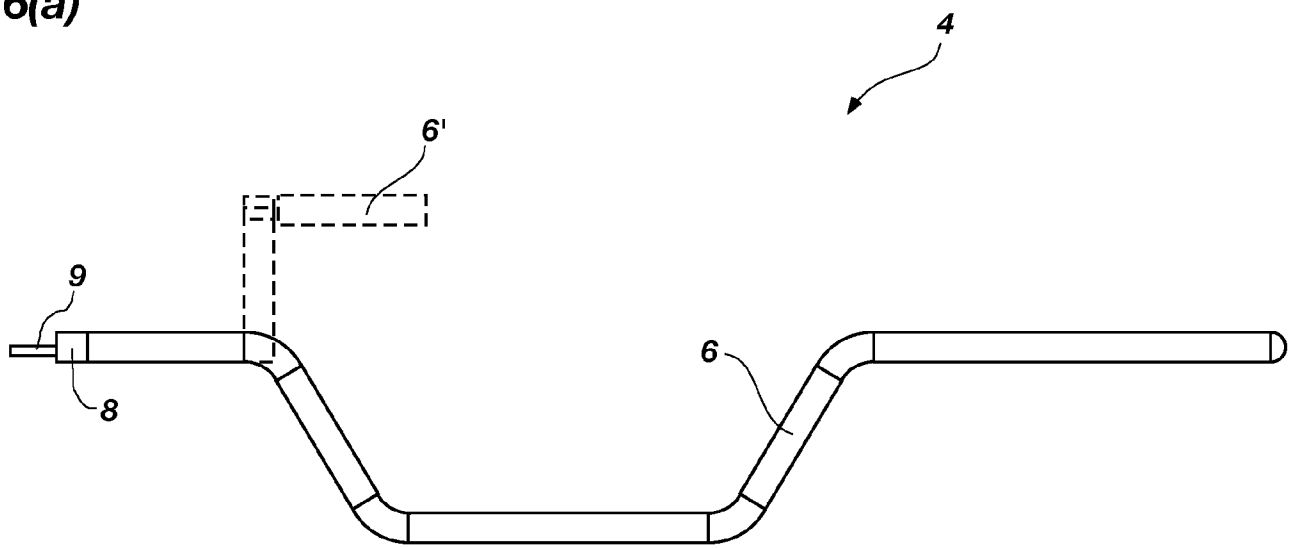

Illustrated in FIGS. 6*a* and 6*b* is the crank 4 which can be used to turn the release spindle and operate the winch system. That crank can have a profiled crank tip 8 which can engage the cutout in the actuator disc. The profiled crank tip can have a square shape, a hexagonal shape, or any other standard or customized design that can be configured to mate with the corresponding actuator disc receiver or cutout. In one aspect of the invention, the tip of the crank can further be equipped with a smaller-diameter extension 'nose' or rod 9 that projects further into a comparably-sized bore in the axle portion of the release spindle, providing a stabilizing slip-fit which can loosely hold the extension nose to reduce crank wobble during operation.

Figure 8B:
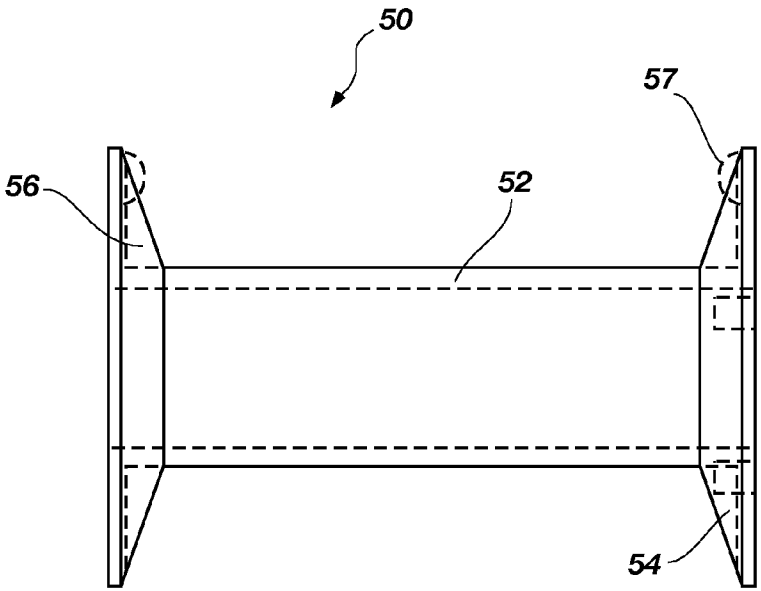
FIGS. 8*a* and 8*b* together illustrate front and side views of a cord spool, according to the exemplary embodiment shown in FIG. 1.
Figure 8A:
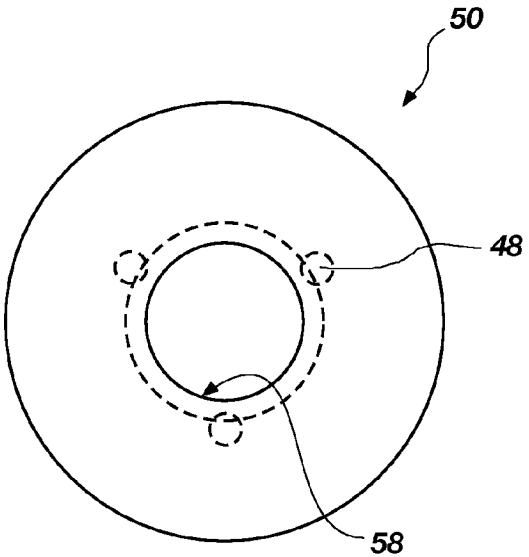

FIGS. 8*a* and 8*b* are illustrative of the cord spool 50, which can be configured to hold and secure the cord, rope or cable used in the internal halyard flagpole system. The proximal end of the cord spool 50 can slide over and can be supported by the axle portion 40 of the rotating release spindle 16, while the distal end can be supported by the non-rotating support shaft 60. To allow for rotation about both rotating and fixed support structures, the cord spool 50 can be provided with a bushing surface 58 inside the tubular portion 52. The proximal end of the cord spool 50 can be also configured with a means for attaching 48 the roller cam 70, such as the three threaded holes for machine screws shown in the exemplary embodiment.

The cord spool 50 can generally be described as a hollow tube 52 with two end pieces or flanges 54, 56 defining a central recess or landing, the flanges and the landing providing the support boundaries for the cable or cord. In one aspect of the invention, the inner walls or sides or surfaces of the flanges 54, 56 can comprise a tapered configuration or orientation with respect to the landing (e.g., they can slope outwards and upwards from the landing to create a bowl-shaped profile). However, due to the sloped nature of the walls of the flange, the cable may be encouraged to "climb" the wall and thus get situated beyond the flanges. Thus, in another aspect, the inner walls or sides or surfaces of the flanges 54 56 can comprise an orthogonal configuration or orientation with respect to the landing (e.g., be perpendicular, or 90 degrees, to the outer surface of the landing 52), in order to discourage the cable from climbing the wall and traveling beyond the flange. In a further aspect, one or more nubs 57 or other protrusions or guides can also be formed along the inner walls of the flanges 54, 56 to further prevent the cable from traveling outside the edges of the spool 50. The nubs 57 can also facilitate or urge winding of the cable away from the flange wall before the cable has a chance to contact the inner wall. This, again, helps to keep the cable properly constrained between the two flanges and about the spool.

Figure 9A:
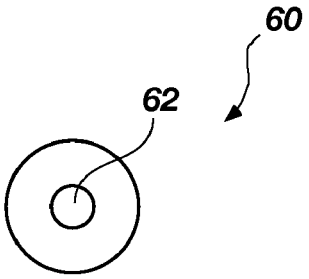
FIGS. 9*a* and 9*b* together illustrate a front and side views of a support shaft, according to the exemplary embodiment shown in FIG. 1.
Figure 9B:
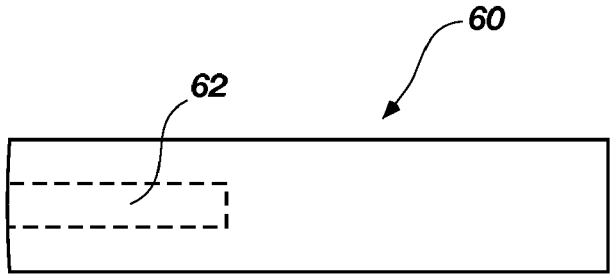

The support shaft 60, shown in FIGS. 9*a* and 9*b*, can be configured with a threaded hole 62 that can be engaged by a machine screw attached through the back sidewall of the flagpole. During installation the support shaft 60 can be aligned with the axle portion of the release spindle to form a single axis of rotation for the cord spool. Having the same diameter as the axle portion, the non-rotating support shaft 60 carries the distal end of the cord spool by occupying the gap between the end of the axle and far sidewall of the flagpole.

Figure 10A:
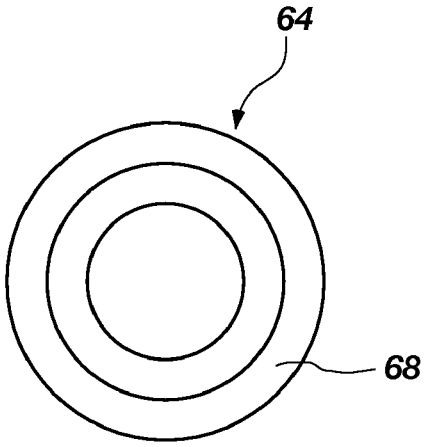
FIGS. 10*a* and 10*b* together illustrate front and side views of a spool spacer, according to the exemplary embodiment shown in FIG. 1.
Figure 10B:
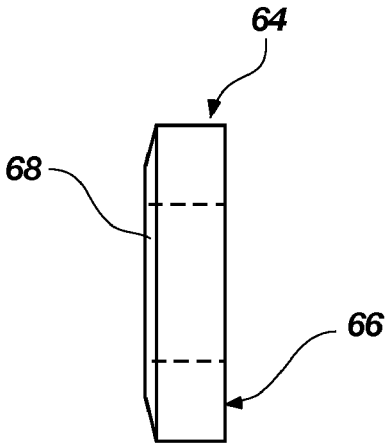

The spool spacer 64, as shown in FIGS. 10*a* and 10*b*, can be configured to fit over the support shaft. It can include a tapered distal edge 68 that fits against the curved interior face of the far sidewall to provide a more rigid connection between support shaft/spool spacer sub-assembly and the far sidewall of the flagpole, while the opposite, proximal face 66 of the spool spacer 64 has a bushing surface that allows the cord spool to contact the spool spacer and still rotate freely. And furthermore, the length of the spool spacer 64 can be configurable to fill any remaining distance between the distal end of the cord spool and the far sidewall.

Figure 11A:
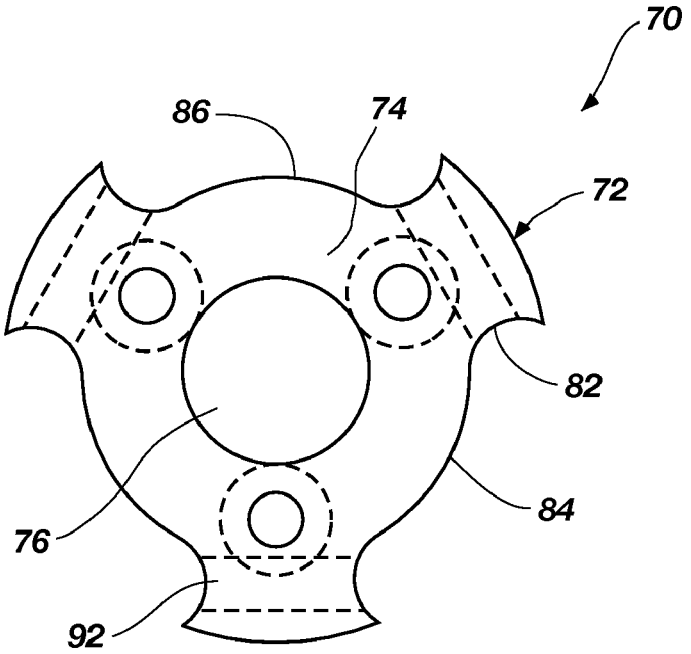
FIGS. 11*a* and 11*b* together illustrate front and side views of a roller cam, according to the exemplary embodiment shown in FIG. 1.
Figure 11B:
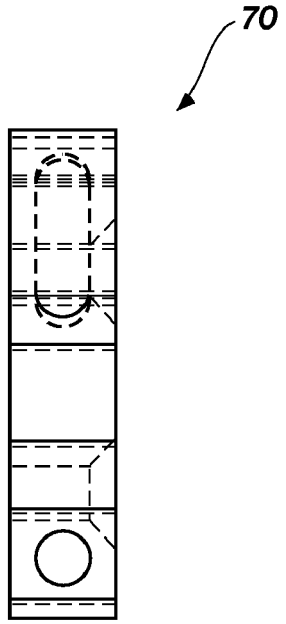

FIGS. 11*a* and 11*b* are illustrative of the roller cam 70, which can have multiple symmetrically curved sprockets 72 extending radially from a central disc section 74. In the exemplary embodiment shown, the roller cam 70 has three sprockets 72 and can be joined to the proximal end of the cord spool with machine screws that attach through three countersunk holes, one in each sprocket 72. The central disc section 74 can have a central passage 76 which allows the roller cam/cord spool sub-assembly to slide onto the axle portion of the release spindle.

Figure 12A:
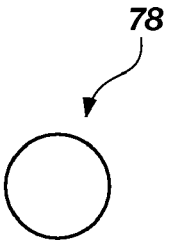
FIGS. 12*a* and 12*b* together illustrate front and side views of a locking roller, according to the exemplary embodiment shown in FIG. 1.
Figure 12B:
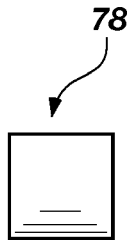

The sprockets 72 on the roller cam 70 can be symmetric, meaning that either side of the sprocket 72 can be a mirror image of the other. The outer edges of the sprockets 72 can have an outer radius that fits inside the inner diameter of the brake ring. Immediately below the outer edge can be rounded indentations, or pockets 82, on both sides of the sprocket 72. These pockets 82 can be deep enough to accommodate the locking rollers 78 (see FIGS. 12*a* and 12*b*) and allow them to freely spin without contacting the brake ring. The bottom portion of each pocket 82 can smoothly merge with the central disc section 74 and follow the contour of the central disc section 74 around to the next sprocket 72, forming a land section 84 between the sprockets 72. However, this land section 84 may not be concentric with the center of the roller cam 70. Instead, the land section 84 can have a slightly greater outward curvature with respect to the radius of the disc section, eventually reaching a peak 86 in the center between the two sprockets 72, and then a slightly greater inward curvature to the next sprocket 72. This change in curvature can give the land section 84 between any two sprockets 72 a slightly mounded profile.

The increase in the outward curvature of the land section 84 can be enough to narrow the gap between the roller cam 70 and the brake ring such that a locking roller 78 will become lodged between the two surfaces. This simultaneous dual contact between the roller cam 70 and the locking roller 78 and between the locking roller 78 and the brake ring, when repeated about the circumference of the roller cam 70 preferably by at least one other locking roller 78, provides the locking mechanism which temporarily restrains the roller cam 70/cord spool 50 sub-assembly in any particular rotational position.

Figure 13B:
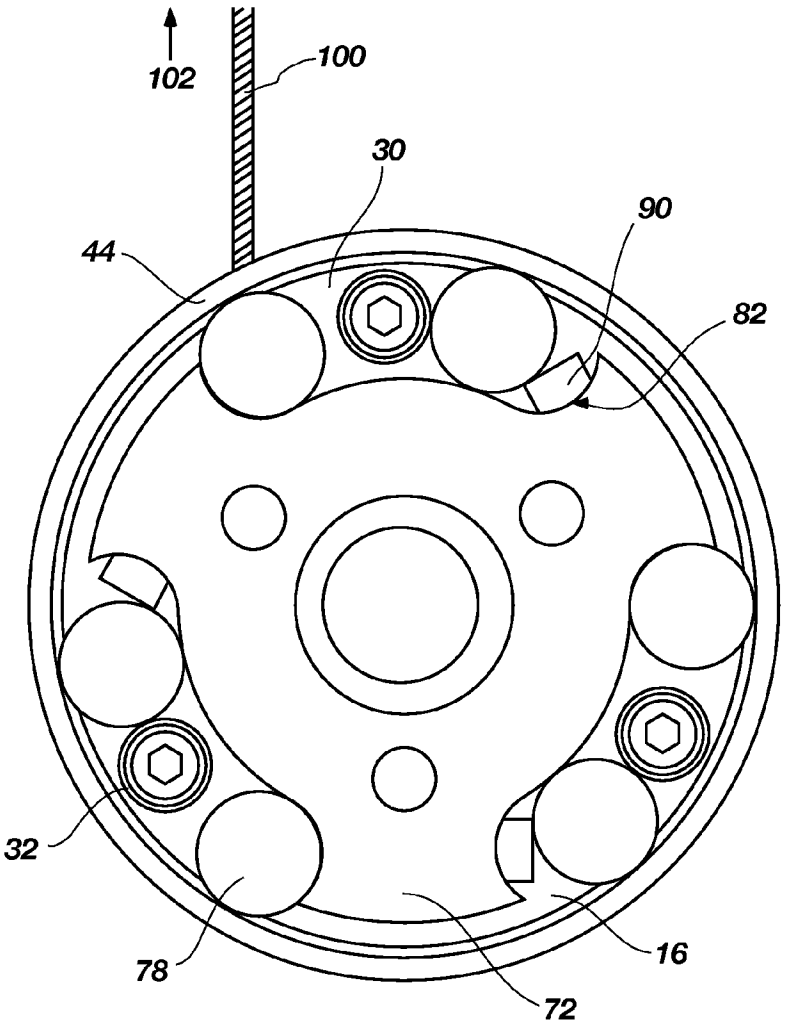
FIGS. 13*a* and 13*b* together illustrate perspective and front views of the assembled clutch mechanism, in its locked and non-turning state, according to the exemplary embodiment shown in FIG. 1.
Figure 13A:
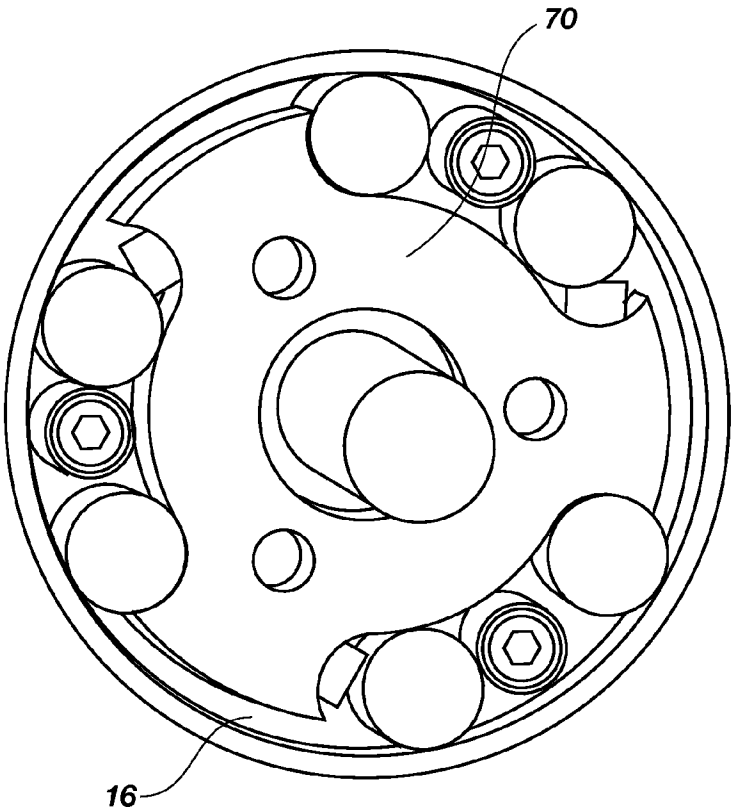

The clutch mechanism is shown in its assembled position in FIGS. 13*a* and 13*b*, with the roller cam 70 slidably contacting the actuator disc 30, and with both the roller cam 70 and the actuator disc 30 fitting snuggly inside the brake ring 44 of the brake drum 14. In the exemplary embodiment, the three sprockets 72 can fit between the three cam unlock rollers 32 projecting from the actuator disc 30, and six non-fixed locking rollers 78 can be placed in the spaces between the sprockets 72 and the cam unlock rollers 32. Each sprocket 72 can also be configured with a hole 92 between the pockets 82 to house two spring-loaded actuator pins 90, one for each pocket 82. The actuator pins 90 can be spring-loaded and can be made from or coated with Teflon or a similar low-friction, longwearing Teflon-like substance. The actuator pins 90 can serve to push the locking rollers 78 away from the pockets 82 and up the sloped land section 84, while at the same time the Teflon coating can allow the locking rollers 78 to freely spin against the actuator pins 90.

FIG. 13*b* further depicts the roller cam 70 in a locked position. In the illustration, the roller cam 70 can be under a preload 102 to rotate clockwise, such as provided by tension on a cord 100 attached to the cord spool 50. However, the roller cam/cord spool sub-assembly can be prevented from turning clockwise by the three locking rollers 78 that have rolled up onto the mounded land sections 84 and become wedged between the roller cam 70 and the inner surface of the brake ring 44. The other three locking rollers 78 can be in neutral, non-locking positions within the opposite pockets 82. In addition, the cam unlock rollers 32 can also be in resting neutral positions against the three locked rollers 78, although they may be free to move between the roller on either side as the actuator disc 30 of the release spindle rocks back and forth.

If the cord 100 attached to the cord spool preloads the roller cam 70 to turn in the clockwise direction, then rotating the roller cam 70 in the counter-clockwise direction would wind more cord 100 onto the spool. This can be accomplished by turning the release spindle 16 in the counter-clockwise direction, as viewed from the perspective of FIG. 13*b*. Turning the release spindle 16 counter-clockwise can cause the cam unlock rollers 32 to first rotate around and push against the locking rollers 78 initially at rest in the left hand pockets 82, forcing them against the right hand side of each sprocket 72. The continued application of torque to the release spindle can then force the roller cam 70 itself to rotate counter-clockwise. This releases the opposite locking rollers 78 wedged on the mounded land sections 84 and allows them to slide down into trailing pockets 82 against the biased actuator pins 90. As long as turning force is applied to the release spindle, the roller cam/cord spool sub-assembly can rotate counter-clockwise and additional cord 100 will be wound onto the cord spool. However, as soon as the turning torque is released, the preload 102 can force the roller cam 70 to rotate back a few degrees clockwise, which immediately causes the locking rollers 78 in the right hand pockets 82 to again roll back up onto the mounded land sections 84 and become wedged again between the roller cam 70 and the brake ring 44, locking the winch 10 into its new rotational position.

The same process can apply in unwinding cord 100 from the winch, except in the opposite direction. Starting again from the locked position depicted in FIG. 13*b*, the release spindle 16 can be turned clockwise, so that the cam unlock rollers 32 now compresses the spring-loaded actuator pins 90 and force the wedged locking rollers 78 to slide down out of their locked positions and into the right hand pockets 82, well clear from the outer brake ring 44. The continued application of torque to the release spindle 16 forces the roller cam 70 to turn clockwise, unwinding the cord spool 50 in a controlled fashion. When the turning torque is finally released, the preload 102 on the cord spool can cause the roller cam 70 to continue turning clockwise, but now the cam unlock rollers 32 are no longer keeping the locking rollers 78 in the right hand pockets 82, and the natural motion of the roller cam 70, along with the force induced by the biased actuator pins 90, can cause the locking rollers 78 to roll back up on the mounded land sections 84 and once again lock the roller cam 70/cord spool 50 sub-assembly into another rotational position.

The internal winch 10 of the present invention can thus be turned in a controlled fashion in both directions, to either wind cord 100 onto or unwind cord 100 off of the cord spool 50. The torque required to release the locking mechanism and turn the internal sub-assemblies can be minimal, and once the turning force is released the preloaded cord spool can automatically lock itself against the brake ring 44 after turning just a few degrees. The interaction between the roller cam 70, the release spindle 16 and the locking rollers 78 can be similar to the operation of a sprag bearing, with the difference being that the present invention is able to release, rotate and lock in both rotational directions.

Figure 14:
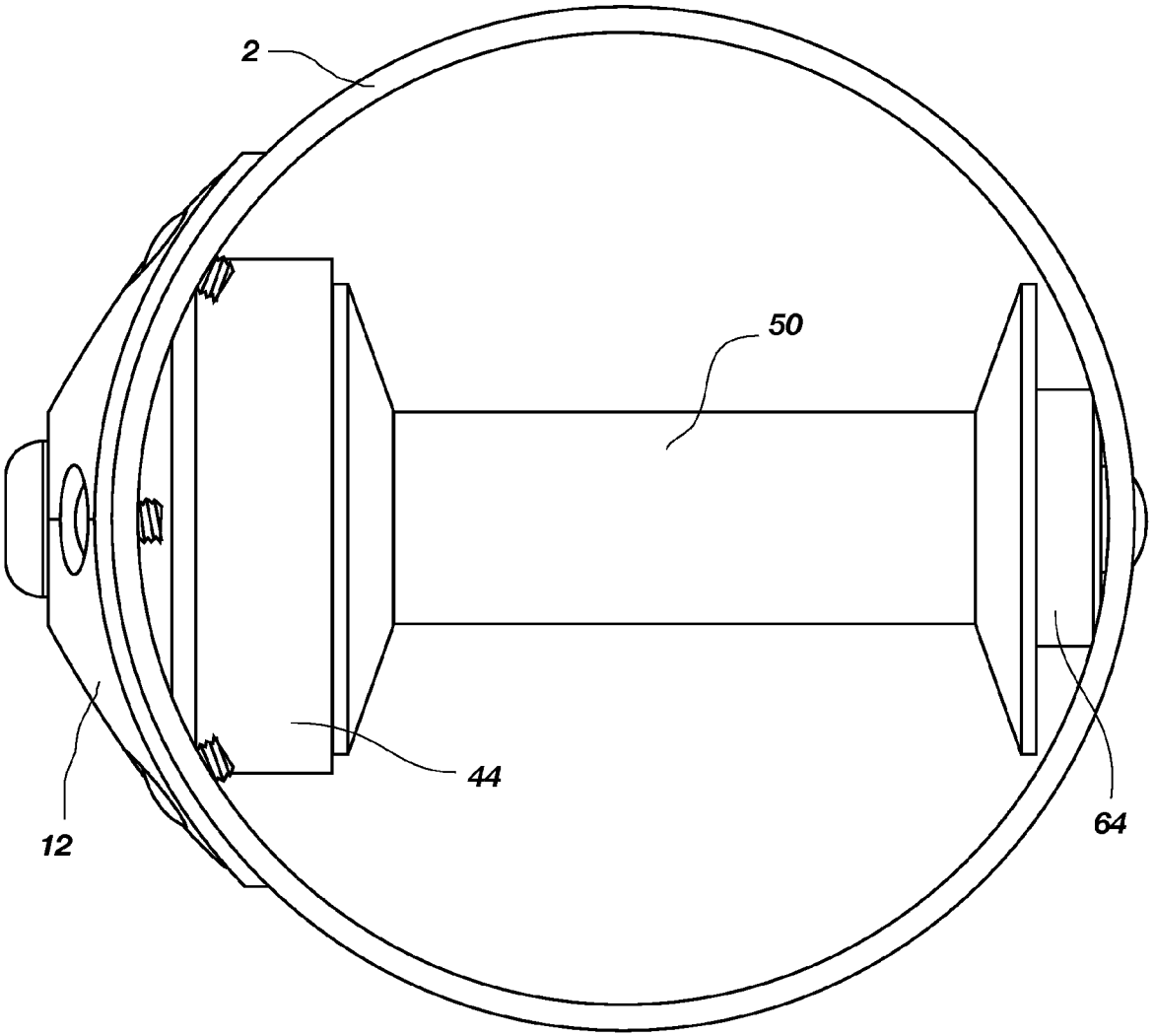
FIG. 14 illustrates a top view of the assembled and installed winch system, in accordance with the exemplary embodiment of FIG. 1.

The assembled exemplary embodiment is shown after installation in a flagpole 2 in FIG. 14. As can readily be seen, the length of the cord spool 50 can be sized to nearly span the entire internal diameter of the flagpole 2 to maximize the capacity of the internal winch. The remainder of the distance can be occupied by the brake drum 14 at the proximal end of the cord spool 50 and the spool spacer 64 at the distal end. Both the release spindle and the roller cam can be completely enclosed within and shielded by the brake drum 14. Furthermore, the spool spacer 64 can be just long enough to provide enough clearance so that the distal end piece of the cord spool 50 does not contact the far sidewall of the flagpole 2. Unlike the prior art, the present invention can be supported from a center axis and requires neither a cage structure or an external shield to support both ends of the cord spool 50. This both increases the capacity of the internal winch 10 over the prior art and greatly reduces its opportunity for clogging.

In one embodiment of the present invention, the cord spool 50 can come in a variety of lengths in order to completely span the internal cavity of a number of differently sized flagpoles. In an alternative embodiment, however, the size of the principal components of the internal winch 10, including the length of the cord spool 50, can be fixed in a "one-size-fits-all-flagpoles-of-a-similar-height" marketing system. Under these circumstances it is the support shaft 60 and the spool spacer 64, the two components attached to the far sidewall of the flagpole 2, which can be made with different lengths to accommodate the variations in flagpole diameters. As these two components are far simpler to make than the cord spool 50, the manufacturing and inventory costs for a line of internal winches can be reduced considerably.

Also as shown in FIG. 14, the installation of the present invention within the flagpole 2 can be greatly simplified. Only a single large winch hole needs to be cut in one sidewall of the flagpole 2, with a smaller hole for the distal end support screw drilled directly opposite and in line with the winch hole. After de-burring the cut surfaces, the entire internal winch assembly can be slid into the winch hole and secured at the distal end with one machine screw, and at the proximal end with six self-taping screws through recessed holes in the cover plate. The simplified installation eliminates the costly welding, annealing, and painting required by the prior art, and yet results in a structurally sound flagpole which can be just as strong as unmodified counterpart.

Figure 15:
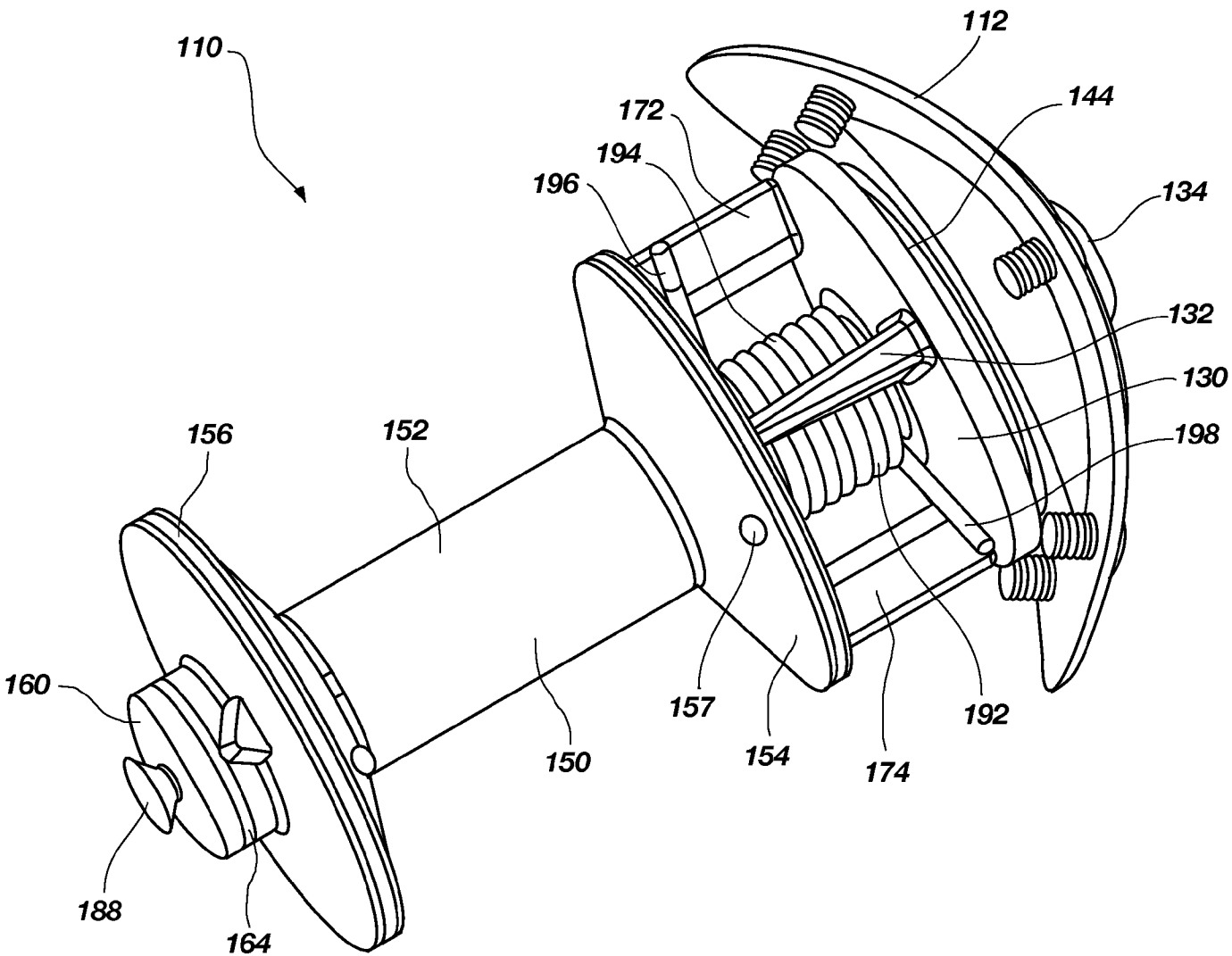
FIG. 15 illustrates a perspective view of an internal winch system in accordance with another exemplary embodiment of the present invention.
Figure 16:
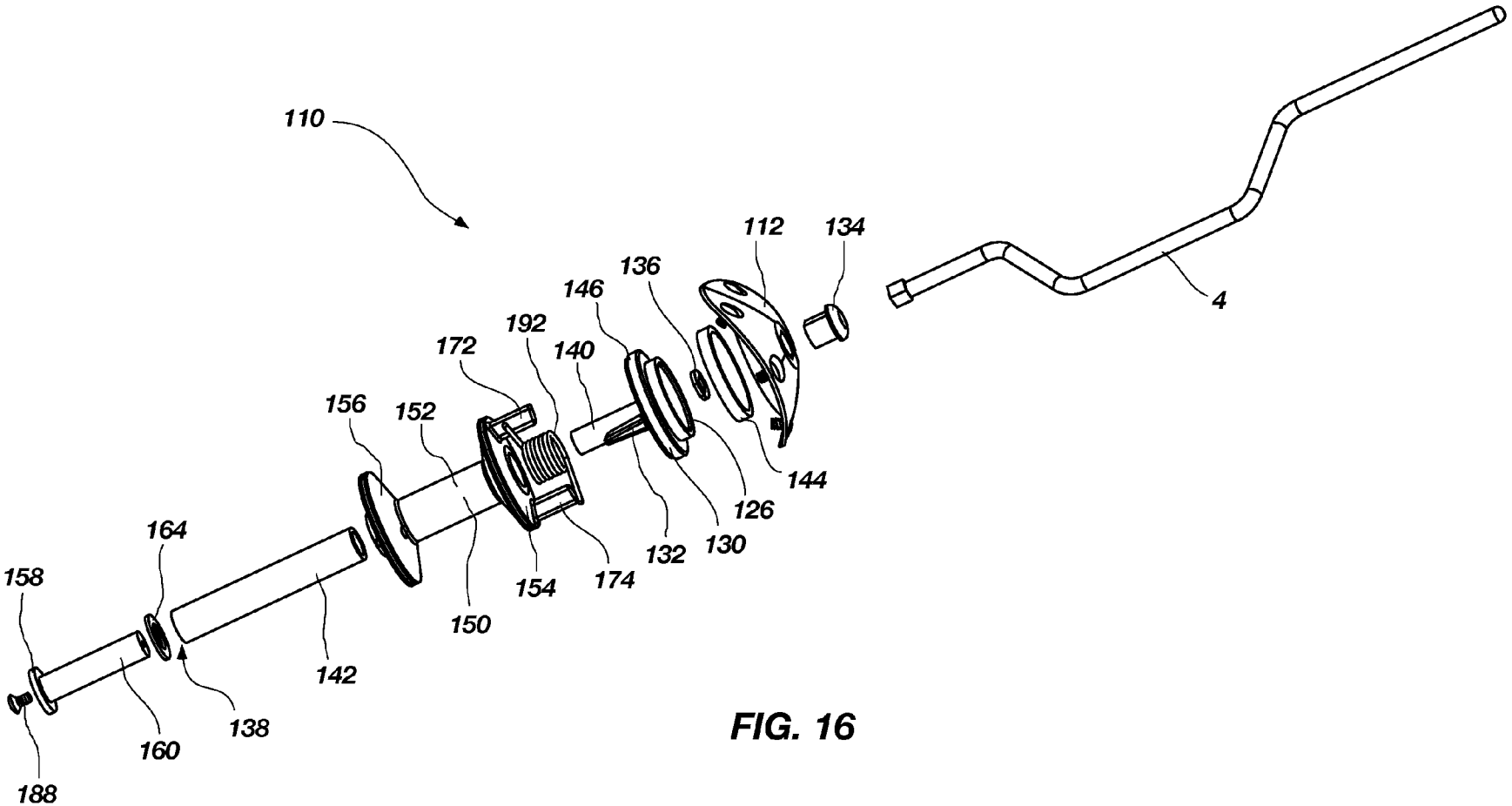
FIG. 16 illustrates an exploded view of the internal winch system of FIG. 15.

With reference to the perspective assembled and exploded views of FIGS. 15 and 16, respectively, illustrated is another exemplary embodiment 110 of the winch or winch system of the present invention that is ideally suited for use with a flagpole as part of an internal halyard system. As shown, the winch 110 comprises a spool 150 that can be rotatably supported about an elongate bushing 142, wherein the spool 150 has a bore that allows it to slide over and freely rotate about the elongate bushing 142. The spool 150 can further comprise first and second flanges 154, 156 located at opposing ends, and a landing 152 situated therebetween. The spool 150 can be configured to receive and support and retain a cord, rope, wire or other flexible line 100 as part of an internal halyard system and as commonly known in the art. The spool 150 also comprises first and second spool arms 172, 174 that extend outward from the flange 154 as shown.

As described in the previous embodiment, the inner surfaces of the first and second flanges 154, 156 of the spool 150 can slope outwards and upwards to create a bowl-shaped profile. In another aspect, however, the inner surfaces can be orthogonal, or 90 degrees, to the landing surface 152 in order to discourage the cable from climbing the walls and traveling beyond the flanges. Nubs 157 can also be formed along the inner edges of the flanges 154, 156 to urge winding of the cable in an opposing direction (e.g., towards the opposite flange) and to further reduce the likelihood of the cable traveling outside the spool 150.

The elongate bushing 142, and hence the spool 150, can be supported by a mounting shaft 160 at a distal end and an actuator shaft 140 at a proximal end. As can be seen in FIG. 16, the elongate bushing can have a length that is greater than the length of the spool piece, so that while the distal portion of the elongate bushing can be aligned flush with the second spool flange 156, a proximal portion of the elongate bushing projects beyond the first spool flange 154 as it fits over the actuator shaft 140. As will be discussed below, this projecting proximal portion of the elongate bushing 142 provides a fixed surface against which the rotating spool piece can be secured.

At the distal end of the internal winch, the mounting shaft 160 can operate with a fastener 188 to secure one side of the winch 110 to a flagpole. The mounting shaft 160 can couple to the inside surface of a flagpole with a flange portion 158 having an outer surface that conforms to the contour of the inside surface of the flagpole, to help to prevent the mounting shaft from rotating during normal operating conditions of the internal winch 110. The fastener 188, such as a screw, bolt, etc., releasably engages the mounting shaft 160 through an aperture formed in the wall of the flagpole to facilitate internal mounting of the winch 110.

The mounting shaft 160 can be fixed and non-rotating. In one aspect of the invention, the elongate bushing 142 can be press fit onto the mounting shaft 160, thus also fixing the elongate bushing 142 in a non-rotating state. In another aspect, the mounting shaft 160 can be provided with a square or non-round cross-section that is smaller than a corresponding square or non-round bore in the distal end of the elongate bushing 140, leaving a gap between the two components. During assembly of the elongate bushing 142 to the mounting shaft 160, this gap can be filled with an elastomeric or resilient material 138 to provide a flexible yet secure fit between the non-rotating mounting shaft and elongate bushing. This flexibility can allow for a greater lateral tolerances in positioning the aperture for the restraining fastener 188 in the rear portion of the flagpole.

Adjacent the spool 150 can be an actuator 130 having an actuator shaft 140 extending outward from a head portion 146 on one side, which actuator shaft 140 can be inserted into the bushing 142 at an end opposite that configured to receive the mounting shaft 160. The actuator shaft 140 can be configured to fit within the elongate bushing 142, and to facilitate the free rotation of the actuator 130 within and about the elongate bushing 142. The actuator 130 can be contained or situated between the elongate bushing 142, which proximate end abuts the head portion 146 of the actuator 130, and the ring bushing 144, and can freely rotate between these two components. The actuator 130 can further comprise a rim or circular flange 126 extending outward from the head portion 146 in a direction opposite than that of the actuator shaft 140. The actuator 130 can be configured to freely rotate within or about a ring-bushing 144 that mates with the actuator 130 via the flange portion 126 of the actuator 130. The ring bushing 144 can be configured to be supported or seated within a cover plate 112 in order to provide support to the actuator 130 and the spool 150 at an end of the winch 110 opposite that of the mounting shaft 160. In other words, the components can be assembled together and supported within the flagpole at one end by the mounting shaft 160 (which mounts directly to the flagpole) and at an opposite end by the cover plate 112 (which also mounts directly to the flagpole). The actuator 130 can further comprise an actuator arm 132 extending outward from the head portion 146 in the same direction as the actuator shaft 140.

Situated between the spool 150 and the actuator 130 and about or over the elongate bushing 142 can be a torsion spring 192 having first and second ends 196, 198 extending linearly a distance from a coiled portion 194, which first and second ends 196, 198 are each configured to engage and interact with the first and second spool arms 172, 174 located on the spool 150. The first and second ends 196, 198 of the torsion spring 192 can also each be configured to engage and interact with the actuator arm 132 of the actuator 130. The interaction between these components is discussed in more detail below.

A cover plate 112 can be configured to mount to the exterior surface of a flagpole to support the ring bushing 144 about an interior surface of the cover plate 112. The ring bushing 144 in turn can operate with and directly supports the actuator 130. With the components of the winch 110 assembled, the cover plate 112 can function to operably support these about the flagpole, and to provide a cover enclosing the winch 110 within the interior of the flagpole. The assembly and interaction of each of the above-identified components operates to provide an internal winch system 110 supported within a flagpole, and operable with a halyard system.

A crank 4, as illustrated in FIG. 6 and described previously above, may be used to operate the winch 110, and particularly actuate the actuator 130 of the winch 110, to manipulate the halyard system. To facilitate this, the actuator 130 can include means for interfacing with the crank 4 (or other member), such as a key hole formed in the head of the actuator, which key hole can correspond to and be configured to receive an end of the crank 4. As so configured, the crank 4 may be inserted through the cover plate 112 and into the key hole of the actuator 130 to engage the actuator, whereupon rotation of the actuator 130 operates the winch 110.

The present invention winch may further comprise a lock 134 operable with the cover plate 112 to prevent unauthorized access to the internal winch 110. The lock 134 can include a pawl 136 that can be rotated in different directions or to different positions by a key or other unlocking member to lock and unlock the lock 134. The pawl can be sized and shaped to correspond with an aperture, particularly an oblong aperture, formed in the cover plate 112. Upon aligning the pawl 136 and the aperture 130, the lock 134 can be unlocked and may be removed, thus providing access to the winch 110. The pawl 136 may also be positioned so that the lock 134 can be locked, wherein the pawl 136 is out of alignment with the aperture 130, and access to the winch 110 denied.

The present invention winch may further comprise a spacer or bushing 164 situated between the mounting shaft 160 and the elongate bushing 142. This bushing is preferably non-metal to eliminate a metal to metal contact between the mounting shaft 160 and the elongate bushing 142.

Under normal operating conditions, the winch of the present invention can secure the flexible line 100 wound around the spool 150, preventing inadvertent rotation of the spool 150. To wind or unwind the flexible line 100, the spool 150 can be configured to rotate only upon being positively manipulated. Stated differently, the winch 110 can be configured such that the spool 150 rotates only when actuated on by the actuator 130. This is the case with respect to rotation in either direction. Advantageously, the present invention winch can provide bi-directional locking or arresting of the spool 150 to prevent inadvertent rotation of the spool 150 and unwinding of the flexible line 100 in either direction, and also bi-directional actuation of the spool 150 to positively operate the winch 110 to wind or unwind the flexible line 100 from the spool 150 in either direction.

To prevent unwanted rotation of the spool 150, and also to secure the flexible line 100, the rotation of the spool 150 can be arrested as a result of the torsional spring 192 clamping down, binding, or otherwise closing upon the projecting proximal end of the elongate bushing 142. This clamping effect can be achieved by one of the spool arms 172, 174 coming in contact with one of the first or second ends 196, 198 of the torsion spring 192. The torsion spring 192 can be situated such that upon induced rotation of the spool 150 (e.g., that resulting from a tension force being induced within the flexible line 100, which tension force pulls on the spool 150 and creates a tendency to rotate the spool 150 in a direction to unwind the flexible line 100), depending upon the direction of rotation, one of the spool arms 172, 174 can be caused to engage and exert a force on one of the spring ends 196, 198. This action can induce a torsional force within the torsional spring 192 that causes the inside diameter of the coiled portion 194 of the torsional spring 192 to contract or shrink. As this happens, the torsional spring 192 effectively clamps down on the outer surface of the elongate bushing 142, thus arresting further rotation of the spool 150 and preventing the unwinding of the flexible line 100 from the spool 150.

The above described functionality can be present within the winch 110 no matter the direction of the induced rotation of the spool 150. In other words, the winch 110 can prevent inadvertent rotation of the spool 150 in any direction. Thus, it can be said that the winch 110 operates on the basis of positive manipulation and rotation of the spool 150 in order to wind and unwind the flexible line 100. Indeed, to rotate the spool 150 in either direction, and thus to wind or unwind the flexible line 100, the actuator 130 can be caused to be rotated in the desired direction. As the actuator 130 can be rotated about its axis, the actuator arm 132 can be caused to come in contact with one of the first and second ends 196, 198 of the torsion spring 192, depending upon the direction of rotation of the actuator 130. As the actuator arm 132 engages the end of the spring 196, 198, and as the rotation of the actuator 130 can be caused to be continued, the actuator arm 132 exerts a force on the end of the spring 196, 198 that functions to induce an inverse torsional force within the spring 192, which inverse torsional force effectively functions to expand the inner diameter of the coil portion 194 of the torsion spring 192. While this inverse torsional force may not of any great magnitude, it can be enough to permit the torsional spring 192 to resist clamping down on and instead freely rotate about the elongate bushing 142. Steady or continued application of rotational force in this direction by the actuator 130 on the torsional spring 192 causes the spool 150 to also rotate, thus facilitating the winding or unwinding of the flexible line 100 from the spool 150. In operation, the winch 110, and more particularly the actuator 130, may be actuated using a crank 4 or other member configured to engage and operate with the actuator 130.

Figure 17:
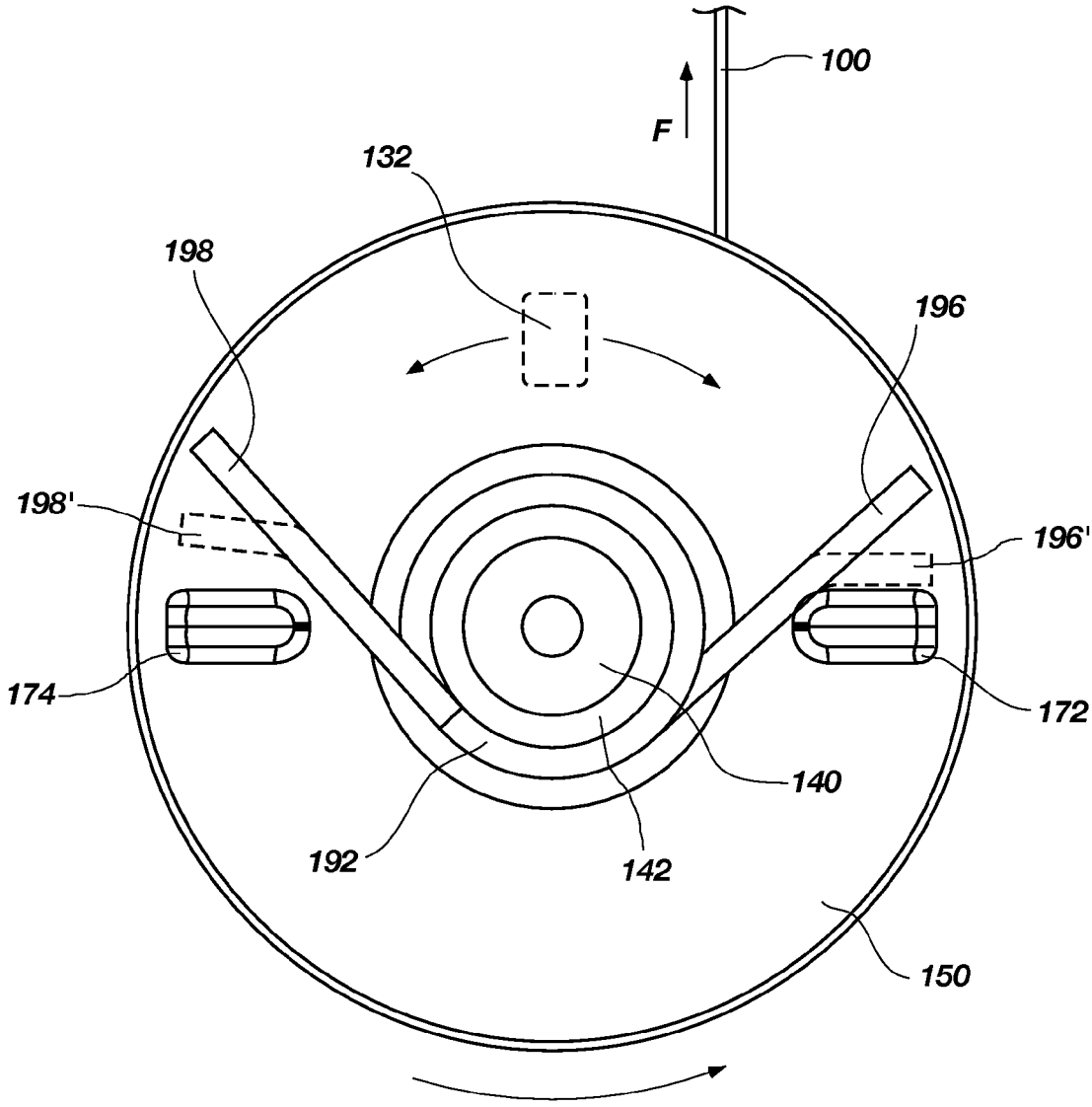
FIG. 17 illustrates an end view of the internal winch system of FIG. 15, with the spool shown as being rotated counterclockwise causing the first spool arm to come in contact with the first spring end, thus inducing a torsion within the torsion spring and causing it to clamp down on the bushing, arresting the rotation of the spool.

FIG. 17 illustrates a partial end view of the winch system 110 of FIG. 15. As shown, the flexible line 100 or halyard can be subject to a tension force F inducing or having a tendency to induce rotation of the spool 150 in a counterclockwise direction. Under these conditions, the spool 150 can be allowed to rotate only until the first spool arm 172 comes in contact with the first spring end 196 and exerts a force on the first spring end 196, which contact and resulting force causes a torsional force to be induced within the torsion spring 192. This torsional force can cause the torsional spring 192 to contract and clamp down and bind about the proximal portion of the elongate bushing 142 arresting further rotation of the torsional spring 192 and also the rotation of the spool 150. With the torsional spring 192 clamped down on the elongate bushing 142, thus becoming statically positioned, any further rotational force induced in the spool 150 by the flexible line 100 will be ineffective to further rotate the spool 150. This is due to the interaction and contact of the first spool arm 172 with the first spring end 196. The first spring end 196 essentially serves as a stopper to the first spool arm 172. The stiffness within the torsional spring 192, and particularly within the first spring end 196, can be configured to be sufficient enough to withstand the rotational force of the spool 150 and the forces applied by the first spool stop. Indeed, the winch system 110 may be designed to comprise a torsional spring 192 having a torsional or spring constant sufficient to withstand the types of loads experienced by a halyard system. Different winch systems may obviously comprise different torsional springs with different spring constants as will be recognized by those skilled in the art.

The first and second spool arms 172, 174 may be positioned about the spool 150 to contact and engage the spring ends 196, 198 at any location along their linear extension. As one skilled in the art will recognize, the further from the central axis of the torsional spring 192 this contact takes place, the stiffer the torsional spring 192 will have to be due to the increased mechanical advantage obtained the further radially outward the contact position is located from the central axis. As shown, the first spool arm 172 can be configured to contact the first spring end 196 at approximately a midpoint between the central axis of the torsional spring 192 and a terminal end of the first spring end 196. In another aspect of the invention, the torsional spring can be formed with the first spring end 196' in a more flattened orientation to provide greater contact surface area between the first spring end 196' and the first spool arm 172.

Figure 18:
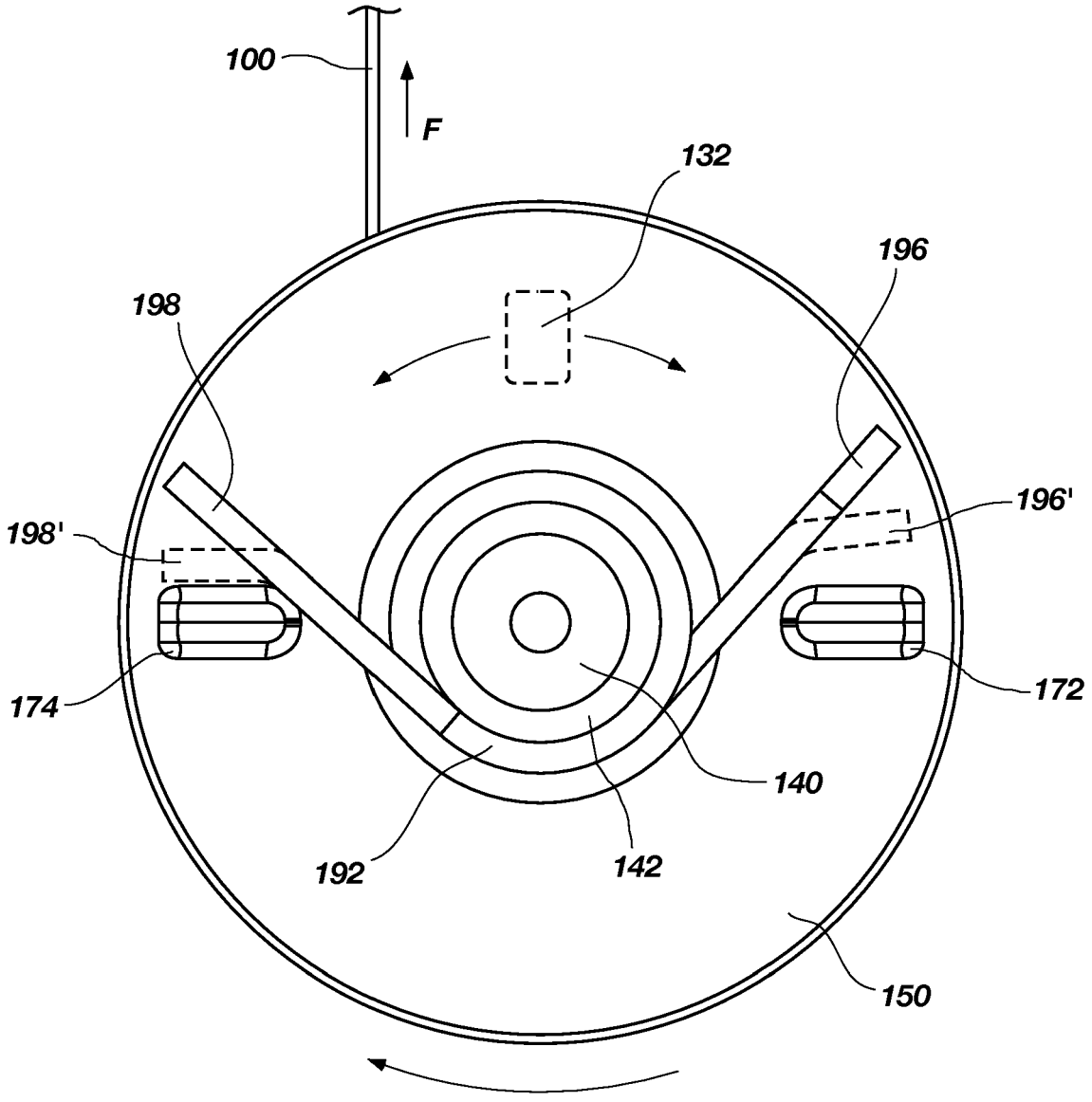
FIG. 18 illustrates an end view of the internal winch system of FIG. 15, with the spool shown as being rotated clockwise causing the second spool arm to come in contact with the second spring end, thus inducing a torsion within the torsion spring and causing it to clamp down on the bushing, arresting the rotation of the spool.

With reference to FIG. 18, illustrated is a partial end view of the winch system 110 of FIG. 15. As shown in this particular operating condition, the flexible line 100 or halyard can be subject to a tension force F inducing or having a tendency to induce rotation of the spool 150 in a clockwise direction. Under these conditions, the spool 150 can be allowed to rotate only until the second spool arm 174 comes in contact with the second spring end 198 and exerts a force on the second spring end 198, which contact and resulting force can cause a torsional force to be induced within the torsion spring 192. This torsional force can cause the torsional spring 192 to contract and clamp down and bind about the proximal portion of the elongate bushing 142 arresting further rotation of the torsional spring 192 and also the rotation of the spool 150. With the torsional spring 192 clamped down on the elongate bushing 142, thus becoming statically positioned, any further rotational force induced in the spool 150 by the flexible line 100 will be ineffective to further rotate the spool 150. This is due to the interaction and contact of the second spool arm 174 with the second spring end 198. The second spring end 198 essentially serves as a stopper to the second spool arm 174. The stiffness within the torsional spring 192, and particularly within the second spring end 198, are configured to be sufficient enough to withstand the rotational force of the spool 150 and the forces applied by the second spool stop.

Similar to the first spool arm 172 described above, the second spool arm 174 can be configured to contact the second spring end 198 at approximately a midpoint between the central axis of the torsional spring 192 and a terminal end of the second spring end 198. In another aspect of the invention, the torsional spring can be formed with the second spring end 198' in a more flattened orientation to provide greater contact surface area between the second spring end 198' and the second spool arm 174.

Referring now to FIGS. 17 and 18 collectively, to positively operate the winch 110 and rotate the spool 150 in either direction to wind or unwind the flexible line 100, the actuator 130 can be engaged with a driving member, such as a crank 4, and caused to be rotated in the desired direction. For example, to wind the flexible line 100 about the spool 150 (assuming the flexible line 100 is positioned as shown in FIG. 17), the actuator 130 can be caused to rotate in a clockwise direction. As the actuator 130 rotates, the actuator arm 132 can be caused to come in contact with and engage the first spring end 196. As indicated above, this can induce an inverse torsional force within the torsional spring 192 preventing it from contracting and clamping down on the surface of the elongate bushing 142. Instead, the torsional spring 192 expands to increase the diameter of the coiled portion 194 with respect to the diameter of the elongate bushing 142. Continued rotation of the actuator 130 eventually causes the first spring end 196 to come in contact with and engage the first spool arm 172, which rotates the spool 150 in the clockwise direction and further winds the flexible line 100 about the spool 150. Similarly, to unwind the flexible line 100 from the spool 150, the actuator 130 can be caused to rotate in the counterclockwise direction. As the actuator 130 rotates, the actuator arm 132 can be caused to come in contact with and engage the second spring end 198, which can induce a similar inverse torsional force within the torsional spring 192 due to the configuration of the torsional springs to provide ends 196, 198 extending outward at offset positions with respect to one another and a central axis of the torsional spring 192. Continued rotation of the actuator 130 causes the second spring end 198 to come in contact with and engage the second spool arm 174, which rotates the spool 150 in the counterclockwise direction, unwinding the flexible line 100 from the spool 150.

Figure 19:
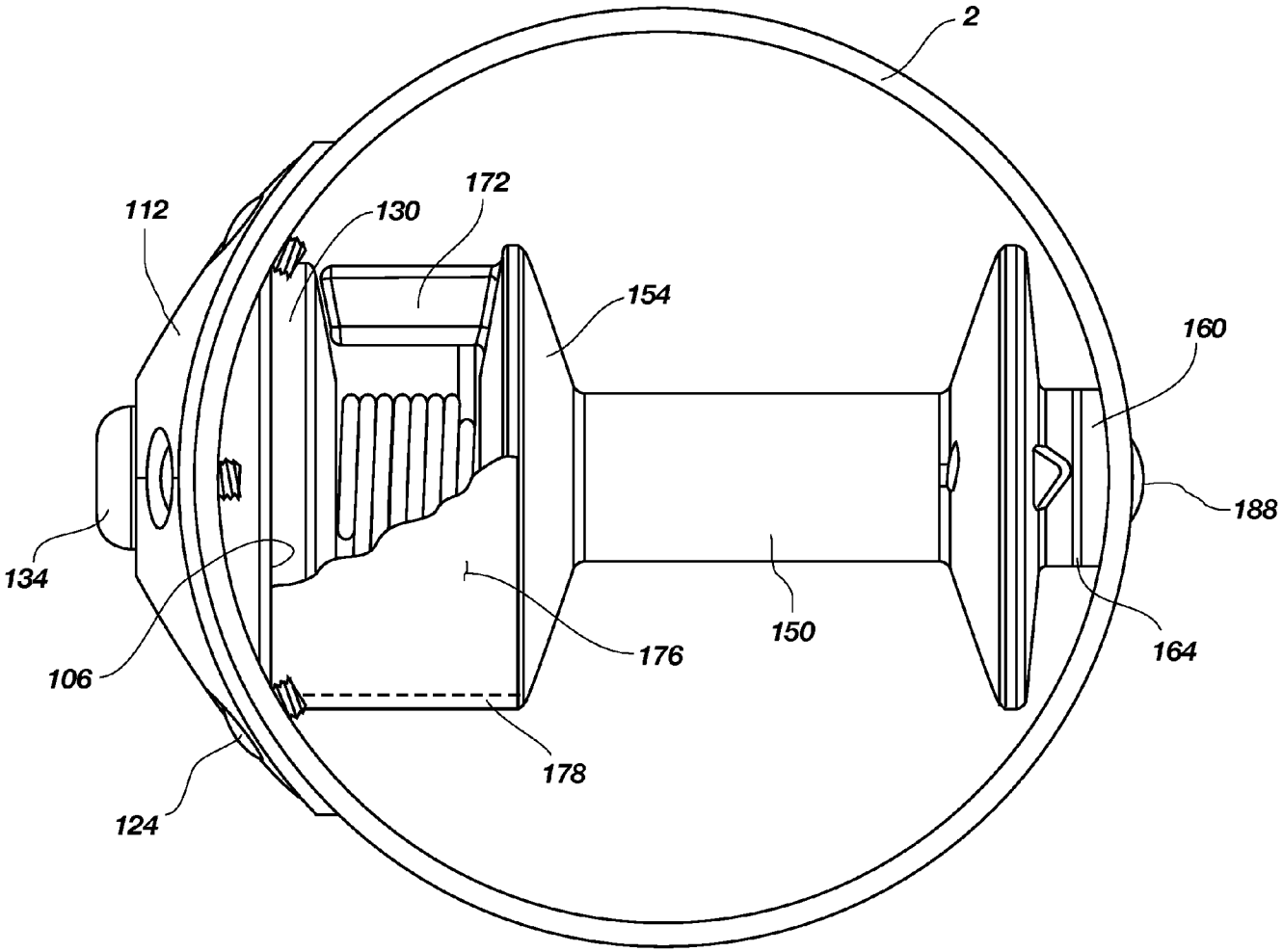
FIG. 19 illustrates a top view of the internal winch system of FIG. 15, as contained and supported within a flagpole.
Figure 20:
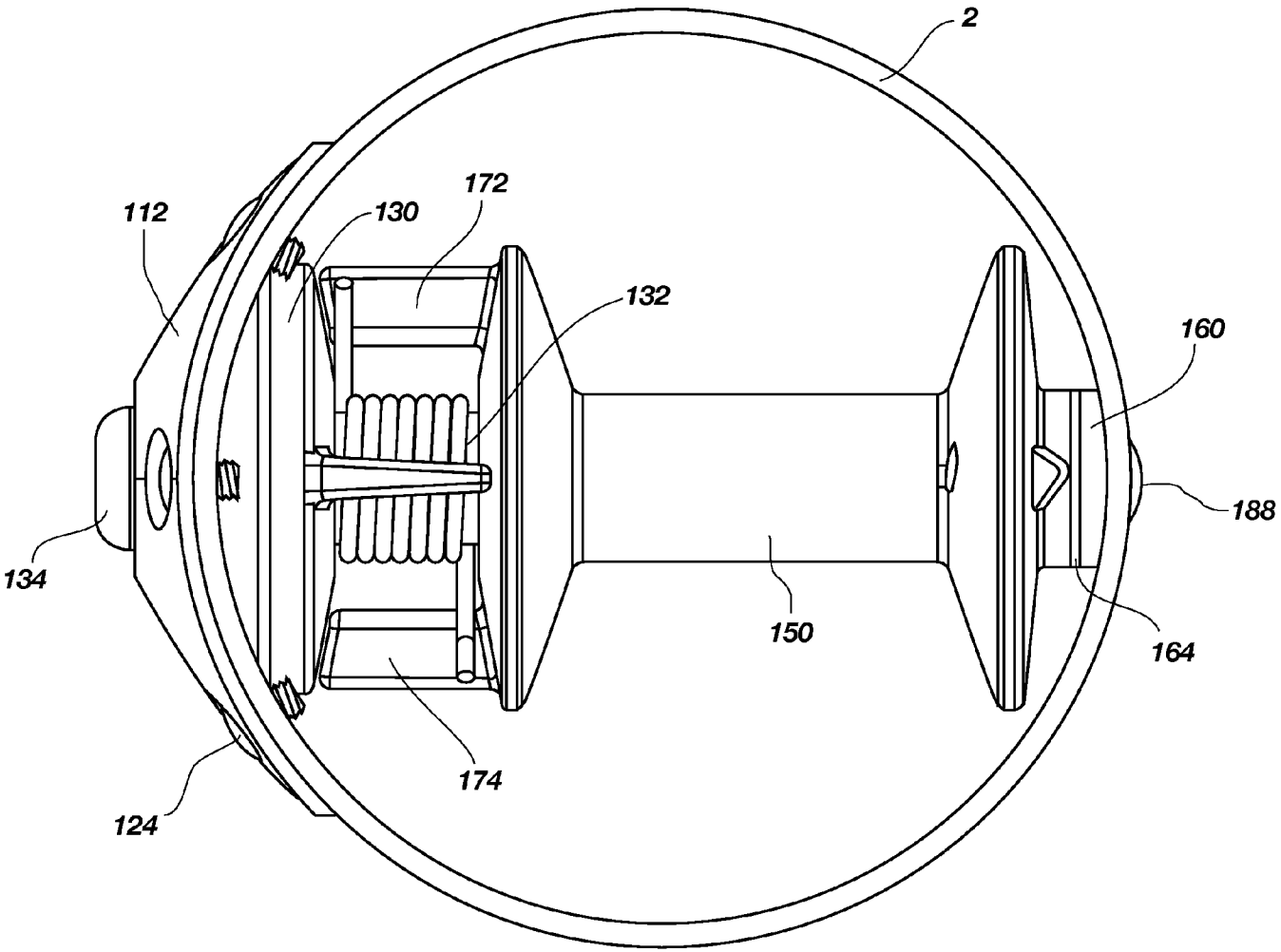
FIG. 20 illustrates a bottom view of the internal winch system of FIG. 15, as contained and supported within a flagpole.

With respect to FIGS. 19 and 20, shown are respective top and bottom views of the present invention winch system 110 as supported within a flagpole 2. As can be seen, the cover plate 112 mounts to the outside of the flagpole 2 on one side, thus supporting the winch 110 from this side, with the fastener 188 engaging the mounting shaft 160 to support the winch 110 about the flagpole 2 from the other side. The cover plate 112 can comprise a size and configuration that covers the opening in the flagpole 2 formed to access the interior and insert the winch 110. The cover plate 112 can also comprise a configuration that corresponds to the exterior surface of the flagpole 2. The cover plate 112 may be mounted using fasteners 124, such as bolts, screws, etc.

Further illustrated in FIG. 19 is a shroud 176 which can extend over and protect the actuator portion of the internal winch 110. The shroud can be formed integrally with or coupled to the first flange 154 of the spool 150, and can rotate with the spool during operation of the internal winch. The shroud can extend over the torsional spring, spool arms 172, 174 and the actuator arm, and function to prevent stray loops of the cable from becoming bound within the rotating components of the actuator and spring. The shroud 176 can have a thickness 178, and can extend across the gap to the back face of the cover plate 112, where a circular recess 106 or groove can formed to receive the leading edge of the shroud to completely seal off and protect the actuator portion of the internal winch.

In another aspect of the present invention, the shroud can be fixed to the non-rotating inside back face of the cover plate 112 and extend inwardly, rather than outwardly from the rotating first flange 154 of the spool 150, to cover and protect the actuator portion.

As can be seen, the present invention does not require an intrinsic or built-in housing like many prior related winches. Rather, once assembled and inserted within the flagpole 2 the present invention winch 110 can utilize the flagpole 2 as its housing. Although the exemplary winch 110 shown herein can be sized to extend substantially the diameter of the flagpole 2, one or more spacers 164 may be used in order to allow a single sized winch to be used on a plurality of flagpoles having different diameters. The spacer 164 may be configured to extend between the spool 150 and the mounting shaft 160. In such cases, the mounting shaft 160 may also be configured with different lengths to accommodate different sized flagpoles.

In addition, the present invention winch 110 can be minimally intrusive and provides many installation advantages over prior related winches. For instance, although an opening in the flagpole 2 can be formed to insert the winch 110, the flagpole 2 may not required to be re-tempered after installation of the winch. This is unlike many prior related winches that require the flagpole to be re-tempered, thus weakening or reducing the integrity of the flagpole.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A flagpole winch, configured to fit within a flagpole and with a sidewall of a flagpole and to facilitate winding and unwinding a cord attached thereto, comprising:

a ring bushing having an inner bushing surface;

a release spindle rotatably supported about the ring bushing, the release spindle comprising:

an actuator disc having a front flange rotatably disposed within the ring bushing;

an axle extending from the actuator disc; and an actuator arm extending from the actuator disc;

an elongate bushing having a distal portion and a proximal portion, the distal portion being coupled to a far sidewall of the flagpole and the proximal portion having a bore therein for receiving the axle of the release spindle;

a cord spool rotatably disposed on the elongate bushing and configured to receive and support a flexible line, the cord spool having first and second spool arms; and a torsion spring rotatably disposed about the proximal portion of the elongate bushing and situated between the cord spool and the actuator disc, the torsion spring having first and second spring ends configured to engage the first and second spool arms, wherein a tension force applied to the cord spool by the flexible line causes engagement of one of the first and second spool arms with one of the first and second spring ends, the torsional spring contracting and clamping about the elongate bushing to arrest rotation of the cord spool, and wherein positive rotation of the actuator causes engagement of the actuator arm with one of the first and second spring ends to induce an inverse torsional force within the torsion spring, the torsion spring expanding to facilitate free bi-directional rotation of the cord spool about the elongate bushing.

2. The flagpole winch of claim 1, further comprising a cover plate attachable to an outside surface of the near sidewall of the flagpole, the ring bushing being coupled to a backside of the cover plate.

3. The flagpole winch of claim 2, wherein the cover plate includes a lock to secure the flagpole winch within the internal hollow space of the flagpole.

4. The flagpole winch of claim 1, wherein a manual rotatable force applied to the release spindle is configured to engage the actuator arm with one of the first and second spring ends to overcome the tension force and cause the torsional spring to release the proximal portion of the elongate bushing and allow rotation of the cord spool in the direction of the manual rotatable force.

5. The flagpole winch of claim 1, wherein the release spindle is engageable with a winding device from an outside surface of the cover plate to facilitate rotation of the cord spool.

6. The flagpole winch of claim 1, further comprising a shroud disposed about the release spindle and the torsion spring.

7. The flagpole winch of claim 1, wherein the cord spool further comprises one or more nubs protruding therefrom to urge winding of the flexible line away from a surface on which the nub is supported.

8. The flagpole winch of claim 1, further comprising an elastomeric or resilient material disposed between the elongate bushing and a mounting shaft to provide a flexible, secure fit therebetween, thus providing greater lateral tolerances in positioning the internal winch within the flagpole.

9. The flagpole winch of claim 1, further comprising a crank handle, the crank handle being equipped with an extension rod that projects further into a comparably-sized bore in the axle portion of the release spindle, thus providing a stabilizing slip-fit which can loosely hold the extension rod to reduce crank wobble during operation of the internal winch.

10. A method for actuating and arresting an internal halyard system of a flagpole, the method comprising:

obtaining an internal winch comprising:

a ring bushing having an inner bushing surface;

a release spindle rotatably supported about the ring bushing, the release spindle comprising an actuator disc having a front flange rotatably disposed within the ring bushing, an axle extending from the actuator disc, and an actuator arm extending from the actuator disc;

an elongate bushing having a distal portion and a proximal portion, the distal portion being operable with a far sidewall of the flagpole and the proximal portion having a bore therein for receiving the axle of the release spindle;

a cord spool rotatably disposed on the elongate bushing and configured to receive and support a flexible line, the cord spool having first and second spool arms; and a torsion spring rotatably disposed about the proximal portion of the elongate busing bushing and situated between the cord spool and the actuator disc, the torsion spring having first and second spring ends configured to engage the first and second spool arms, wherein a tension force applied to the cord spool is configured to bind the cord spool to prevent rotation of the cord spool;

applying a positive manual rotatable force to the release spindle, wherein the manual rotatable force is configured to overcome the tensile force and allow rotation of the cord spool in the direction of the manual rotatable force, the manual rotatable force being applicable in both rotational directions; and removing the manual rotatable force to stop rotation of the release spindle and to cause the tension force to again lock and arrest rotation of the cord spool.

11. The method of claim 10, wherein said applying a positive manual rotatable force to a release spindle comprises causing engagement of the actuator arm with one of the first and second spring ends to induce an inverse torsional force within the torsion spring, the torsion spring expanding to facilitate free bi-directional rotation of the cord spool about the elongate bushing.

12. The method of claim 10, wherein said removing the manual rotatable force comprises causing engagement of one of the first and second spool arms with one of the first and second spring ends, the torsional spring contracting and clamping about the elongate bushing to arrest rotation of the cord spool.

13. The method of claim 10, further comprising:

inserting a key into a lock in the cover plate; and turning the key to unlock a lock pawl disposed on the cover plate to access the internal winch.

14. A method for actuating and arresting an internal halyard system of a flagpole, the method comprising:

obtaining an internal winch comprising:

a stationary brake drum;

a rotatable release spindle further comprising an actuator disc and an axle;

a cord spool rotatably disposed on the axle and the support shaft and configured to wind or unwind the flexible line thereon;

a clutch mechanism disposed between the actuator disc and the cord spool and inside the brake drum further comprising:

a plurality of cam unlock rollers coupled to the actuator disc of the release spindle;

a roller cam coupled to the cord spool; and a plurality of floating locking rollers positioned between the cam unlock rollers, the roller cam and the brake drum, wherein a tension force applied to the cord spool is configured to bind the cord spool about a non-rotating bushing to prevent rotation of the cord spool;

applying a positive manual rotatable force to a release spindle, wherein the manual rotatable force is configured to overcome the tensile force and allow rotation of the cord spool in the direction of the manual rotatable force, the manual rotatable force being applicable in both rotational directions; and removing the manual rotatable force to stop rotation of the release spindle and to cause the tension force to again lock and arrest rotation of the cord spool about the non-rotating bushing.

* * * * *